US010337735B2

(12) United States Patent
Hasegawa

(10) Patent No.: US 10,337,735 B2
(45) Date of Patent: Jul. 2, 2019

(54) EXHAUST TUBE HOLDING MEMBER, EXHAUST STRUCTURE FOR COMBUSTION APPARATUS, AND METHOD FOR INSTALLING EXHAUST STRUCTURE FOR COMBUSTION APPARATUS

(71) Applicant: NORITZ CORPORATION, Hyogo (JP)

(72) Inventor: Takahide Hasegawa, Kakogawa (JP)

(73) Assignee: NORITZ CORPORATION, Hyogo (JP)

( * ) Notice: Subject to any disclaimer, the term of this patent is extended or adjusted under 35 U.S.C. 154(b) by 318 days.

(21) Appl. No.: 15/097,865

(22) Filed: Apr. 13, 2016

(65) Prior Publication Data

US 2017/0299176 A1 Oct. 19, 2017

(51) Int. Cl.

*F23J 13/02* (2006.01)
*F23J 13/04* (2006.01)
*B23P 19/04* (2006.01)

(52) U.S. Cl.

CPC ..... *F23J 13/025* (2013.01); *F23J 13/04* (2013.01); *F23J 2213/101* (2013.01)

(58) Field of Classification Search

CPC .. F23J 13/0258; F23J 2213/101; F23J 13/025; F23J 13/04; F16L 7/02
USPC ..... 138/112, 114; 285/109, 110, 124.2, 285/124.3, 124.4, 215, 216
See application file for complete search history.

(56) References Cited

U.S. PATENT DOCUMENTS 717,592 A * 6/1903 Melsha ..... 126/307 R
1,328,647 A 1/1920 Carl
2,857,837 A * 10/1958 Carr ..... F23L 17/02 454/36
3,209,670 A 10/1965 Twickler
4,886,228 A 12/1989 Kennedy
5,286,040 A * 2/1994 Gavin ..... E03F 5/021 220/277
5,393,260 A * 2/1995 Barth ..... F16L 9/18 138/114
5,649,712 A * 7/1997 Ekholm ..... F16L 21/02 277/607

(Continued)

OTHER PUBLICATIONS

An Office Action issued by the U.S. Patent Office dated Aug. 7, 2018, which corresponds to U.S. Appl. No. 15/097,903 and is related to U.S. Appl. No. 15/097,865.

(Continued)

*Primary Examiner* — Avinash A Savani
*Assistant Examiner* — Rabeeul I Zuberi
(74) *Attorney, Agent, or Firm* — Studebaker & Brackett PC

(57) ABSTRACT

An exhaust pipe holding member includes an annular portion, an annular outward protruding portion (protruding piece), and a flange portion. The annular portion is formed with a through hole penetrating from one end through the other end. The outward protruding portion protrudes peripherally outward from the outer peripheral surface of the annular portion. The flange portion is disposed closer to one end than to the outward protruding portion, extending peripherally outward from the outer peripheral surface of the annular portion, and is configured to have a thickness greater than that of the outward protruding portion. The flange portion is formed with an annular groove surrounding the through hole.

11 Claims, 20 Drawing Sheets

(56) References Cited

U.S. PATENT DOCUMENTS

| | | | |
|---|---|---|---|
| 6,634,675 | B2 | 10/2003 | Parkes |
| 7,150,437 | B1 | 12/2006 | Teeters |
| 2015/0056903 | A1 | 2/2015 | Nagano et al. |

OTHER PUBLICATIONS

An Office Action issued by the U.S. Patent Office dated Nov. 16, 2018, which corresponds to U.S. Appl. No. 15/083,846 and is related to U.S. Appl. No. 15/097,865.

* cited by examiner

EXHAUST TUBE HOLDING MEMBER, EXHAUST STRUCTURE FOR COMBUSTION APPARATUS, AND METHOD FOR INSTALLING EXHAUST STRUCTURE FOR COMBUSTION APPARATUS

BACKGROUND OF THE INVENTION

Field of the Invention

The present invention relates to an exhaust tube holding member, an exhaust structure for combustion apparatus, and a method for installing an exhaust structure for combustion apparatus.

Description of the Background Art

A combustion apparatus such as a water heater or a room heater is disposed in such a manner that a main body thereof is installed indoors. For example, in the United States, a tank water heater is primarily used as the water heater, and the tank water heater is installed in such as an indoor boiler room. Exhaust gas generated from combustion in such combustion apparatus is generally emitted outside the roof of a building through an exhaust pipe (B vent).

When replacing such combustion apparatus (for example, a tank water heater) already placed in a building with a new combustion apparatus (for example, an instantaneous water heater), the replacement may encounter such a situation that the outer appearance of the building must be reserved and thereby the already-placed exhaust pipe cannot be removed.

In the situation mentioned above, it is possible to perform the replacement of the combustion apparatus by reusing the already-placed exhaust pipe and inserting a new exhaust tube inside the existing exhaust pipe. It is known that the new exhaust tube (flexible exhaust tube) is held by using an exhaust adapter disclosed in US 2015/0056903A1. On the other hand, the already-placed exhaust pipe may be available on the market with different sizes and shapes, and thus, it is desired that a simple and easy installation method should be adopted to deal with the problem that the exhaust pipe may have different sizes and shapes.

SUMMARY OF THE INVENTION

The present invention has been accomplished in view of the aforementioned problems, and it is therefore an object of the present invention to provide an exhaust tube holding member, an exhaust structure for combustion apparatus and a method for installing an exhaust structure for combustion apparatus, enabling a simple and easy installation to deal with any exhaust pipe with different sizes and shapes.

The exhaust tube holding member of the present invention is formed into an annular shape, and is configured to be supported by an exhaust pipe at a location closer to the side of an outer peripheral surface of the annular shape and to hold an exhaust tube on an inner peripheral surface of the annular shape. The exhaust tube holding member of the present invention includes an annular portion, an outward protruding portion and a flange portion. The annular portion is formed with a through hole penetrating from a first end through a second end. The outward protruding portion is formed into an annular shape and protrudes peripherally outward from the outer peripheral surface of the annular portion. The flange portion is disposed closer to the first end than to the outward protruding portion, extending peripherally outward from the outer peripheral surface of the annular portion, and is configured to have a thickness greater than that of the outward protruding portion. The flange portion is formed with a first annular groove surrounding the through hole.

According to the exhaust tube holding member of the present invention, since the flange portion is formed with the first annular groove, it is easy to cut the flange portion along the first annular groove, making it easy to modify the radial dimension of the flange portion. Thereby, it is possible to modify the radial dimension of the flange portion at an installation site, enabling a simple and easy installation to deal with any exhaust pipe with different sizes and shapes.

In the exhaust tube holding member mentioned above, the first annular groove is formed concentrically with the through hole in planar view. Since the first annular groove is formed concentrically with the through hole, it is easy to hold the exhaust pipe concentrically with the exhaust tube which has been inserted into the through hole.

In the exhaust tube holding member mentioned above, the first annular groove is formed to have an oval shape or an elliptical shape sharing the same central axis with the through hole in planar view. Thereby, it is easy to have the flange portion supported on the exhaust pipe of an oval shape or an elliptical shape.

In the exhaust tube holding member mentioned above, the outward protruding portion is formed with a second annular groove surrounding the through hole. Thereby, it is easy to cut the outward protruding portion along the second annular groove, making it easy to modify the radial dimension of the outward protruding portion. Thus, it is possible to modify the radial dimension of the outward protruding portion at an installation site, enabling a simple and easy installation to deal with any exhaust pipe with different sizes and shapes.

In the exhaust tube holding member mentioned above, the first annular groove and the second annular groove have the same radius in planar view. Thereby, it is possible to efficiently cut the flange portion along the first annular groove and efficiently cut the outward protruding portion along the second annular groove.

In the exhaust tube holding member mentioned above, the depth of the first annular groove is at least half of the thickness of the flange portion. Thereby, it is easier to cut the flange portion along the first annular groove at an installation site.

In the exhaust tube holding member mentioned above, the first annular groove includes a first groove portion formed on one surface of the flange portion closer to the first end, and a second groove portion formed on the other surface of the flange portion closer to the second end. The first groove portion and the second groove portion are formed peripherally opposite to each other in the direction of the central axis of the through hole. Thereby, the cutting marks are formed on both surfaces of the flange portion, which makes it possible to cut the flange portion from either the front surface or the back surface in accordance with installation requirements.

In the exhaust tube holding member mentioned above, the sum of the depth of the first groove portion and the depth of the second groove portion is at least half of the thickness of the flange portion. Thereby, it is easier to cut the flange portion along the first annular groove at an installation site.

An exhaust structure for combustion apparatus of the present invention includes the exhaust tube holding member, the exhaust tube and the exhaust pipe, which are mentioned above, and a rain cap. The exhaust tube has one end and the other end, and is connected to the combustion apparatus at one end. The exhaust tube is introduced inside the exhaust pipe. The rain cap is connected to the other end of the exhaust tube, and is configured to cover the top of the exhaust tube holding member. The annular portion of the exhaust tube holding member is attached to the outer peripheral surface of the exhaust tube, the flange portion is held at the upper end of the exhaust pipe, and the outer peripheral end of the outward protruding portion is in contact with the inner peripheral surface of the exhaust pipe.

According to the exhaust structure for combustion apparatus of the present invention, since the flange portion is formed with the first annular groove, it is easy to cut the flange portion along the first annular groove, making it easy to modify the radial dimension of the flange portion. Thereby, it is possible to modify the radial dimension of the flange portion at an installation site, enabling a simple and easy installation to deal with any exhaust pipe with different sizes and shapes.

A method for installing an exhaust structure for combustion apparatus by using the exhaust tube holding member mentioned above includes the following steps.

Firstly, the flange portion is cut along the first annular groove of the exhaust tube holding member. Next, the exhaust tube which has one end and the other end is connected to the combustion apparatus at one end, and the other end of the exhaust tube is pulled through the exhaust pipe out of an upper end opening of the exhaust pipe. Then, the exhaust tube holding member is attached to the outer peripheral surface of the exhaust tube by introducing the exhaust tube into the through hole of the exhaust tube holding member. Subsequently, the exhaust tube holding member which has been attached to the outer peripheral surface of the exhaust tube is held against the upper end opening of the exhaust pipe.

According to the method for installing of the exhaust structure for combustion apparatus of the present invention, since the flange portion is formed with the first annular groove, it is easy to cut the flange portion along the first annular groove, making it easy to modify the radial dimension of the flange portion. Thereby, it is possible to modify the radial dimension of the flange portion at an installation site, enabling a simple and easy installation to deal with any exhaust pipe with different sizes and shapes.

In the method for installing the exhaust structure for combustion apparatus mentioned above, the cutting of the flange portion along the first annular groove is performed prior to the attaching of the exhaust tube holding member to the outer peripheral surface of the exhaust tube. Thereby, it is possible to cut the flange portion in a free state before the attaching of the exhaust tube holding member to the exhaust tube, allowing the cutting to be performed more accurately.

In the method for installing the exhaust structure for combustion apparatus mentioned above, the cutting of the flange portion along the first annular groove is performed after the attaching of the exhaust tube holding member on the outer peripheral surface of the exhaust tube. Thereby, it is possible to cut the flange portion in a stable state after the attaching of the exhaust tube holding member to the exhaust tube, allowing the cutting to be performed more stably.

In the method for installing the exhaust structure for combustion apparatus mentioned above, the outward protruding portion is formed with a second annular groove surrounding the through hole, and the method further includes cutting the outward protruding portion along the second annular groove. Thereby, it is easy to cut the outward protruding portion along the second annular groove, making it easy to modify the radial dimension of the outward protruding portion. Thus, it is possible to modify the radial dimension of the outward protruding portion at an installation site, enabling a simple and easy installation to deal with any exhaust pipe with different sizes and shapes.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter, embodiments of the present invention will be described with reference to the drawings.

First Embodiment

Firstly, an exhaust structure for combustion apparatus according to a first embodiment of the present invention will be described.

Figure 1:
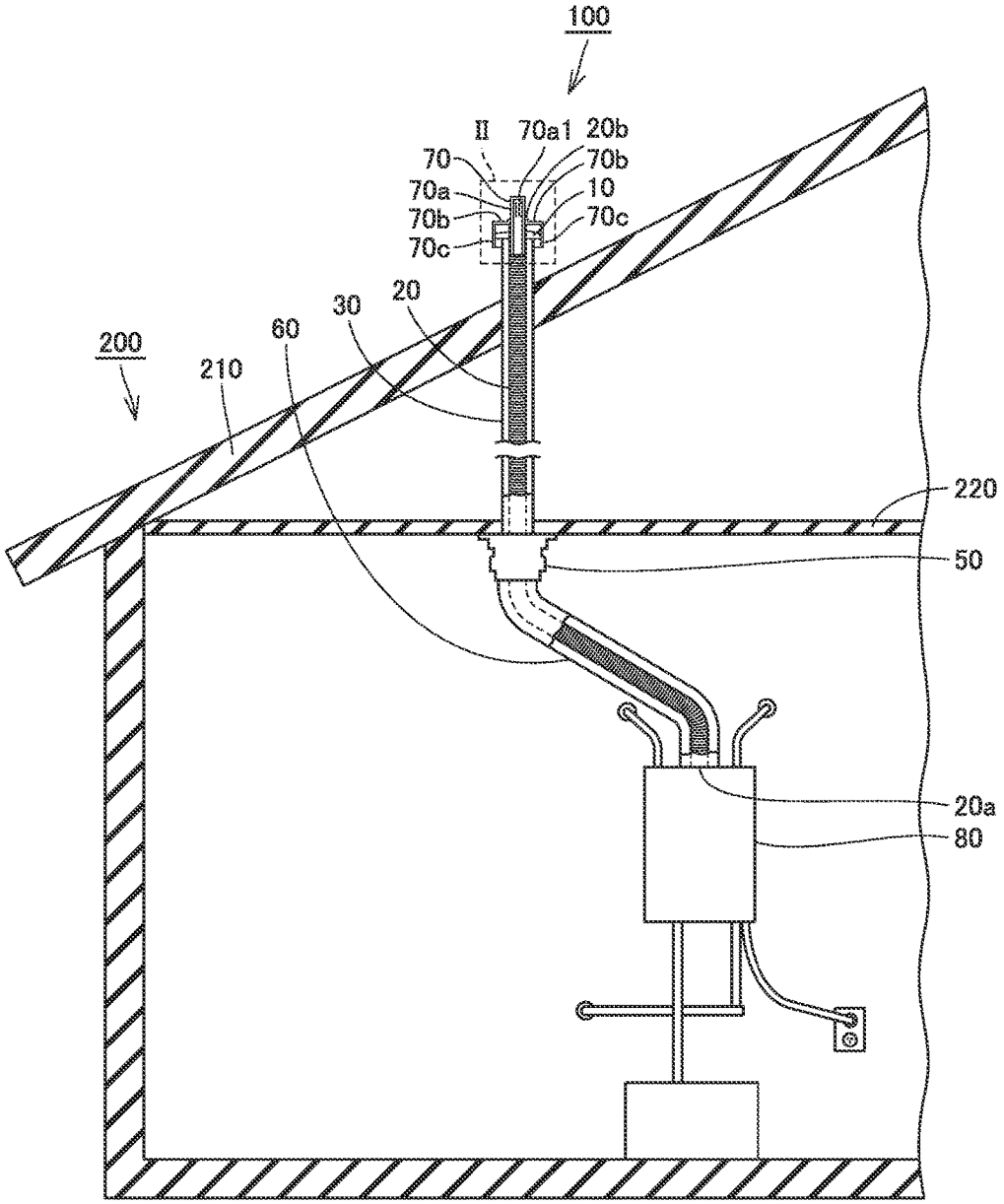
FIG. 1 is a planar view schematically illustrating an exhaust structure for combustion apparatus which has been installed in a building according to a first embodiment of the present invention.

As illustrated in FIG. 1, an exhaust structure for combustion apparatus 100 of the present embodiment generally includes a combustion apparatus 80, an exhaust tube holding member 10, an exhaust tube (flexible exhaust pipe) 20, an exhaust pipe (B-vent) 30, an exhaust tube fixing member 50, a connection pipe 60, and a rain cap (exhaust terminal) 70. Exhaust structure for combustion apparatus 100 is configured to emit combustion gas produced by combustion apparatus 80 to the outside of a building 200.

Combustion apparatus 80 is installed inside building 200. Combustion apparatus 80 may be a water heater for heating water to hot with combustion gas or may be any other combustion apparatus such as a room heater for warming up a room with combustion gas. In the case where a water heater is used as combustion apparatus 80, the water heater may be a water heater adapted to an exhaust suction and combustion system or may be a water heater of a latent heat recovery type.

Exhaust tube 20 has one end 20*a* and the other end 20*b*. Exhaust tube 20 is connected to combustion apparatus 80 at one end 20*a*. The other end 20*b* of exhaust tube 20 extends out to the outside of the building. The interior of exhaust tube 20 forms a discharge path for discharging the exhaust gas generated from combustion in combustion apparatus 80 to the outside. Thus, the exhaust gas produced by combustion apparatus 80 can be guided to the outside through exhaust tube 20.

Exhaust tube 20 is implemented as a flexible pipe such as an accordion pipe, it may be a spiral pipe as well. Thereby, it is possible for exhaust tube 20 to follow the shape of exhaust pipe 30 even it is complicated. Based on the fact that the exhaust gas will pass through the interior of exhaust tube 20, it is preferred that exhaust tube 20 is made from a material having acid resistance. As described in the present embodiment, in the case where combustion apparatus 80 is a water heater of a latent heat recovery type, the exhaust gas may be discharged together with acidic drainage water.

Thus, the material of exhaust tube 20 may be selected from materials having acid resistance such as phenol resin, epoxy resin, silicone resin, fluorine resin such as tetrafluoroethylene, unsaturated polyester resin, melamine resin, polycarbonate resin, methacryl styrene (MS) resin, methacryl resin, styrene acrylonitrile copolymer (AS) resin, ABS resin, polyethylene, polypropylene, polystyrene, polyethylene terephthalate (PET), and vinyl chloride resin.

Exhaust pipe 30 is attached to building 200 so as to extend from the indoor to the outdoor through a roof 210 of building 200, for example. Exhaust pipe 30 may extend from the indoor to the outdoor through a wall of the building. Exhaust pipe 30 has a larger diameter than exhaust tube 20. A part of exhaust tube 20 closer to the other end 20*b* is inserted inside exhaust pipe 30. Exhaust pipe 30 is made of metal, for example. Exhaust pipe 30 has a cross section (orthogonal to the axis direction of exhaust pipe 30) having a circular shape, an oval shape or an elliptical shape, for example. Exhaust pipe 30 is connected to exhaust tube fixing member 50 at the lower end. Note that exhaust pipe 30 is not required to be connected to exhaust tube fixing member 50.

Exhaust tube fixing member 50 is configured to fix exhaust tube 20 relative to exhaust pipe 30. In the case where exhaust tube fixing member 50 is connected to exhaust pipe 30, exhaust tube fixing member 50 is configured to fix exhaust tube 20 relative to exhaust pipe 30. In the present embodiment, exhaust tube fixing member 50 is attached to exhaust pipe 30 at a location closer to combustion apparatus 80 than to exhaust tube holding member 10. In addition, exhaust tube fixing member 50 fixes connection pipe 60 to exhaust pipe 30. It is preferable to fix exhaust tube fixing member 50 to a ceiling 220 of building 200 after it is fixed to both exhaust tube 20 and exhaust pipe 30. Exhaust tube fixing member 50 is preferably made of the same material as exhaust tube 20.

Figure 2:
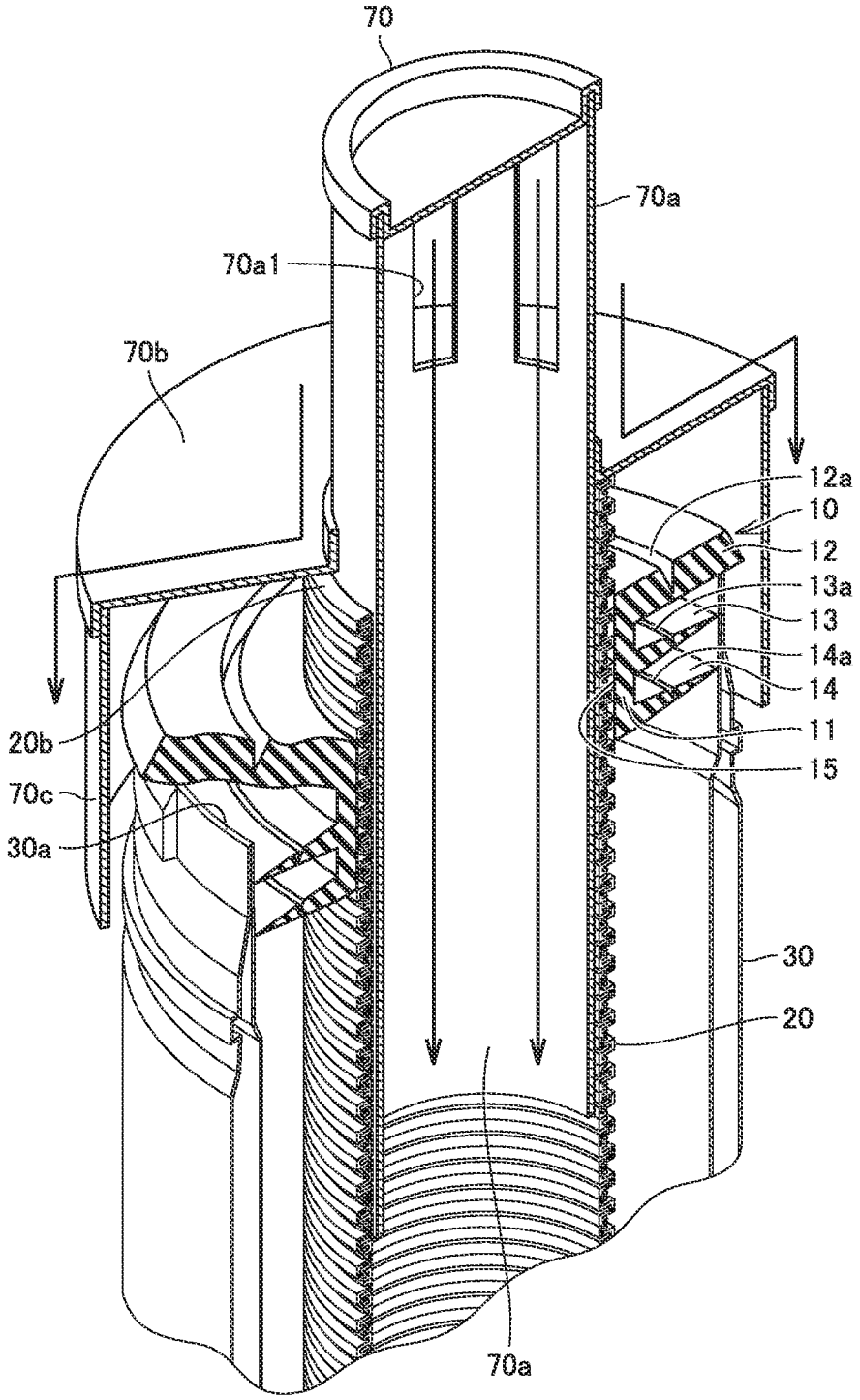
FIG. 2 is a cross-sectional perspective view of a region II in FIG. 1 for the purpose of illustrating how an exhaust tube holding member included in the exhaust structure for combustion apparatus according to the first embodiment of the present invention is used to hold an exhaust tube inside an exhaust pipe.

As illustrated in FIG. 2, rain cap 70 includes a discharge member 70*a* and cover members 70*b* and 70*c*. Discharge member 70*a* has for example a cylindrical shape, and is attached to the other end 20*b* of exhaust tube 20. Specifically, discharge member 70*a* is inserted into exhaust tube 20 from the other end 20*b* of exhaust tube 20, and is thereby attached to exhaust tube 20. The outer diameter of discharge member 70*a* is set larger than the inner diameter of exhaust tube 20. Thus, after discharge member 70*a* is inserted into exhaust tube 20, the inner diameter of exhaust tube 20 is expanded thereby, and thus exhaust tube 20 shrinks so as to reduce the expanded diameter, and the shrinking force helps to support discharge member 70*a* inside exhaust tube 20.

An exhaust vent (discharge unit) 70*a*1 for discharging the exhaust gas after combustion to the outside (outdoor) is formed at the upper end of discharge member 70*a*. With the help of exhaust vent 70*a*1, it is possible to emit the exhaust gas guided by exhaust tube 20 to the outside of building 200 through rain cap 70.

Cover members 70*b* and 70*c* of rain cap 70 cover the top surface and the side surface of exhaust tube holding member 10. Cover members 70*b* and 70*c* include a ceiling 70*b* and a peripheral wall 70*c*. Ceiling 70*b* has a circular ring shape extending from the outer peripheral surface of discharge member 70*a* outward circumferentially. Ceiling 70*b* has an outer diameter greater than the outer diameter of exhaust tube holding member 10 and covers the top of exhaust tube holding member 10. Peripheral wall 70*c* has a cylindrical shape extending downward from the outer peripheral end of ceiling 70*b*. The inner peripheral surface of peripheral wall 70*c* is in contact with the outer peripheral surface of exhaust tube holding member 10. Note that the inner peripheral surface of peripheral wall 70*c* may not be in contact with the outer peripheral surface of exhaust tube holding member 10, and a gap may be formed therebetween. Peripheral wall 70*c* covers the side surface of exhaust tube holding member 10.

In the above, discharge member 70*a* of rain cap 70 is implemented as an inner cover attached to the inner peripheral surface of exhaust tube 20, it may be an outer cover attached to the outer peripheral surface of exhaust tube 20. Rain cap 70 may be made of materials such as aluminum and stainless steel.

As illustrated in FIG. 1, connection pipe 60 is configured to cover exhaust tube 20 and thereby protect exhaust tube 20. Connection pipe 60 is connected to exhaust tube fixing member 50 and combustion apparatus 80. Connection pipe 60 has a larger outer diameter than exhaust tube 20. A part of exhaust tube 20 closer to one end 20*a* is inserted inside connection pipe 60.

Connection pipe 60 is implemented as a flexible pipe such as an accordion pipe, it may be a spiral pipe as well. Since connection pipe 60 is flexible, it is possible for connection pipe 60 to follow the shape of exhaust tube 20 easily. Moreover, since connection pipe 60 is flexible, it is easier to connect connection pipe 60 to combustion apparatus 80.

Connection pipe 60 may be a pipe made of for example aluminum. As a result, it is possible to reduce the self weight so as to reduce the load for exhaust tube fixing member 50 to support connection pipe 60, and meanwhile since aluminum has a certain degree of hardness, it is possible to prevent connection pipe 60 from deformation due to its self weight. Furthermore, since a pipe made of aluminum can be relatively readily processed through cutting or the like, it can be readily adapted to the length of exhaust tube 20, for example.

Exhaust tube holding member 10 is configured to hold exhaust tube 20, which is connected to combustion apparatus 80, inside exhaust pipe 30. Exhaust tube holding member 10 is preferably made of a material having acid resistance. The material of exhaust tube holding member 10 be selected from materials having acid resistance such as ethylene propylene dimonomer (EPDM), phenol resin, epoxy resin, silicone resin, fluorine resin such as tetrafluoroethylene, unsaturated polyester resin, melamine resin, polycarbonate resin, methacryl styrene (MS) resin, methacryl resin, styrene acrylonitrile copolymer (AS) resin, ABS resin, polyethylene, polypropylene, polystyrene, polyethylene terephthalate (PET), and vinyl chloride resin. Exhaust tube holding member 10 may also be a wire or a metal plate, for example.

As illustrated in FIG. 2, exhaust tube holding member 10 is formed into an annular shape, and is formed with a through hole 15 therein. Exhaust tube holding member 10 supports exhaust tube 20 on an inner peripheral surface of through hole 15, and is supported by exhaust pipe 30 at a location closer to the side of an outer peripheral surface of the annular holding member.

Hereinafter, the configuration of exhaust tube holding member 10 mentioned above will be described with reference to FIGS. 3 to 5.

Figure 3:
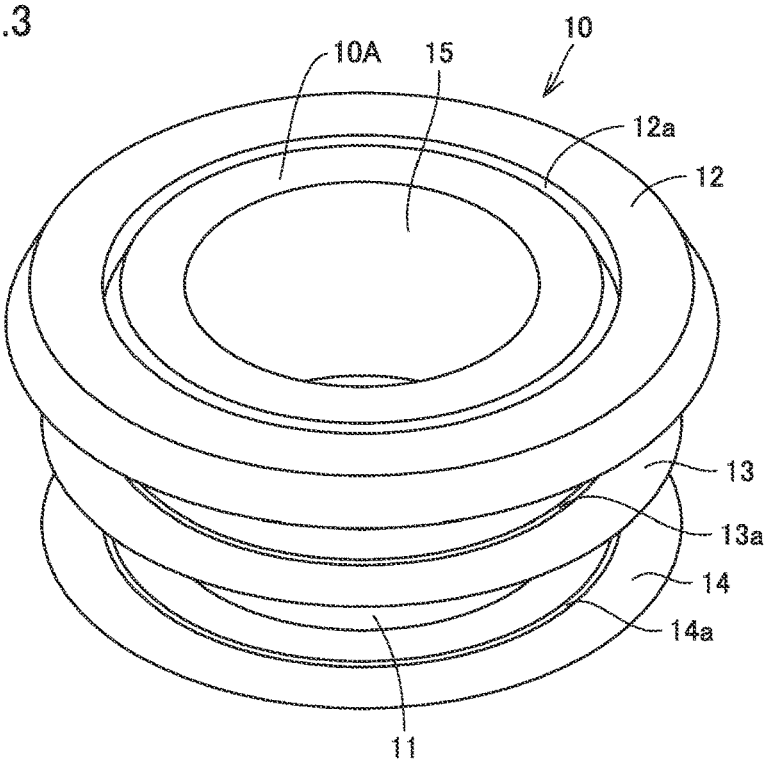
FIG. 3 is a perspective view schematically illustrating the configuration of the exhaust tube holding member included in the exhaust structure for combustion apparatus according to the first embodiment of the present invention when viewed from one end of the exhaust tube holding member.
Figure 4:
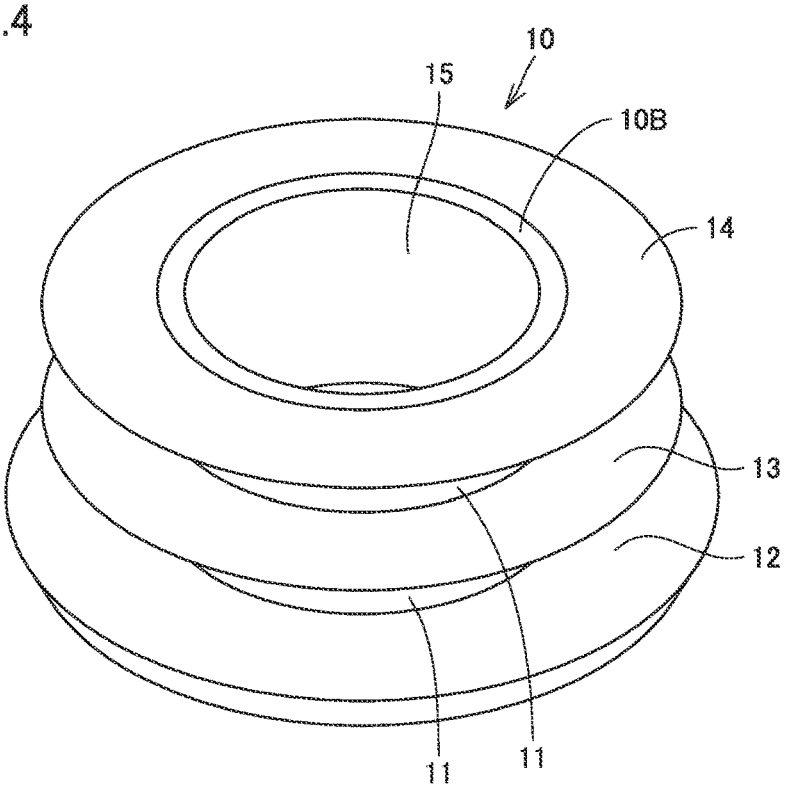
FIG. 4 is a perspective view schematically illustrating the configuration of the exhaust tube holding member included in the exhaust structure for combustion apparatus according to the first embodiment of the present invention when viewed from the other end of the exhaust tube holding member.
Figure 5:
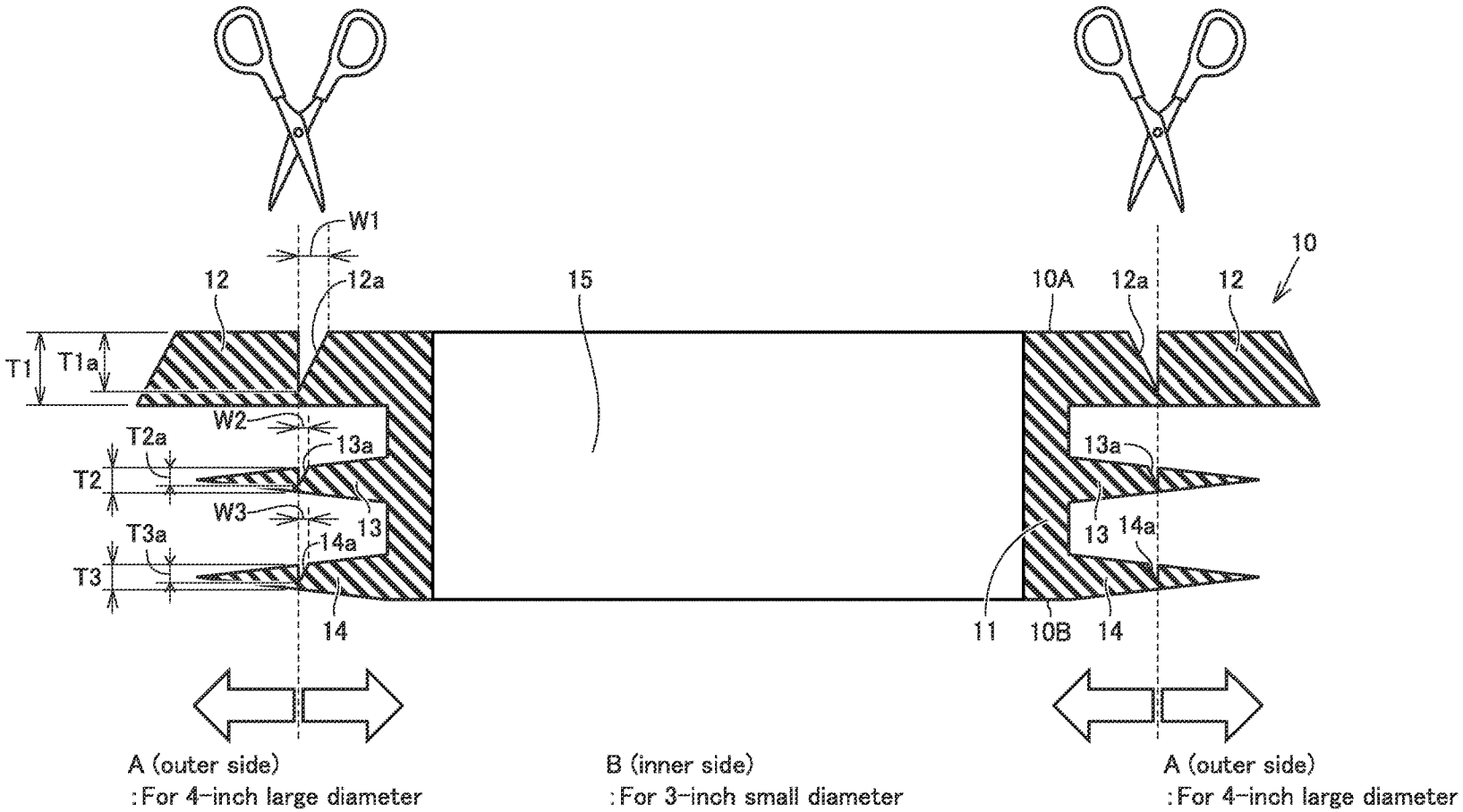
FIG. 5 is a sectional view schematically illustrating the configuration of the exhaust tube holding member included in the exhaust structure for combustion apparatus according to the first embodiment of the present invention.

As generally illustrated in FIGS. 3 to 5, exhaust tube holding member 10 of the present embodiment includes an annular portion 11, a flange portion 12, and outward protruding portions 13 and 14. Annular portion 11 is formed with through hole 15 penetrating from one end (first end) 10A through the other end (second end) 10B of exhaust tube holding member 10. Thus, annular portion 11 has a cylindrical shape. Annular shaped outward protruding portions 13 and 14 protrude peripherally outward from the outer peripheral surface of annular portion 11. Flange portion 12 is formed into an annular shape, and is disposed closer to one end 10A than to outward protruding portions 13 and 14. Flange portion 12 extends peripherally outward from the outer peripheral surface of annular portion 11 greater than outward protruding portions 13 and 14 in the outer peripheral direction. Flange portion 12 is configured to have a thickness greater than that of outward protruding portion 13 or 14.

As generally illustrated in FIGS. 3 and 5, flange portion 12 is formed with an annular groove (first annular groove) 12*a* which surrounds through hole 15. Annular groove 12*a* is formed on a surface of flange portion 12 closer to the side of one end 10A. Annular groove 12*a* is formed to have for example a circular shape, and is arranged concentrically with through hole 15 in planar view (as viewed in the direction from one end 10A toward the other end 10B). As illustrated in FIG. 5, annular groove 12*a* has a depth T1*a* at least half of a thickness T1 of flange portion 12.

As generally illustrated in FIGS. 3 to 5, outward protruding portions 13 and 14 are implemented as a plurality of protruding pieces (for example, two protruding pieces). Each of the two protruding pieces 13 and 14 is formed into an annular shape and have a thickness decreasing in the direction from the bottom end (from the side of the inner peripheral surface) toward the distal end (toward the side of the outer peripheral surface). Protruding piece 14 is positioned on the outer peripheral surface of annular portion 11 at the other end 10B. Protruding piece 13 is positioned between protruding piece 14 and flange portion 12.

As generally illustrated in FIGS. 3 and 5, the two protruding pieces 13 and 14 are formed with annular grooves (second annular groove) 13*a* and 14*a*, respectively. Annular groove 13*a* is formed on a surface of protruding piece 13 closer to the side of one end 10A. Annular groove 13*a* has for example a circular shape in planar view. Annular groove 13*a* surrounds through hole 15, and is disposed concentric with through hole 15. As illustrated in FIG. 5, annular groove 13*a* is formed to have a depth T2*a* at least half of a thickness T2 of protruding piece 13. The outer peripheral end of each of the two protruding pieces 13 and 14 is located inner than the outer peripheral end of flange portion 12 in the radial direction.

As generally illustrated in FIGS. 3 and 5, annular groove 14*a* is formed on a surface of protruding piece 14 closer to the side of one end 10A. Annular groove 14*a* has for example a circular shape in planar view. Annular groove 14*a* surrounds through hole 15, and is disposed concentric with through hole 15. As illustrated in FIG. 5, annular groove 14*a* is formed to have a depth T3*a* at least half of a thickness T3 of protruding piece 14.

As generally illustrated in FIG. 5, annular groove 12*a*, annular groove 13*a* and annular groove 14*a* each has the same radius. Thus, in planar view, annular groove 12*a*, annular groove 13*a* and annular groove 14*a* are superimposed on each other. Annular groove 12*a*, annular groove 13*a* and annular groove 14*a* each is configured to have a respective radial width W1, W2 and W3 decreasing as each annular groove goes deeper. Thus, annular groove 12*a*, annular groove 13*a* and annular groove 14*a* each is formed into a triangular shape in cross section (a V-shaped groove) as illustrated in FIG. 5. Specifically, the inner peripheral wall of each of annular groove 12*a*, annular groove 13*a* and annular groove 14*a* inclines peripherally outward as each annular groove goes deeper, and the outer peripheral wall extends vertically along the extending direction of through hole 15.

Annular groove 12*a*, annular grooves 13*a* and annular grooves 14*a* are designed for the purpose of cutting an outer peripheral portion of flange portion 12, an outer peripheral portion of protruding piece 13 and an outer peripheral portion of protruding piece 14, respectively, by using a pair of scissors or the like (a knife, a cutting tool) at an installation site. In the case where exhaust tube holding member 10 is not cut, as illustrated in FIG. 6, exhaust tube holding member 10 can be used to hold exhaust tube 20 inside exhaust pipe 30 having a relatively large diameter (for example, 4 inches).

Hereinafter, the method of installing the exhaust structure for combustion apparatus of the present embodiment in the case where exhaust pipe 30 has a relatively large diameter (for example, 4 inches) will be described with reference to FIGS. 1, 6 and 7.

As illustrated in FIG. 1, one end 20*a* of exhaust tube 20 is connected to combustion apparatus 80, and the other end 20*b* of exhaust tube 20 is inserted through exhaust pipe 30 from the lower end of exhaust pipe 30.

Figure 6:
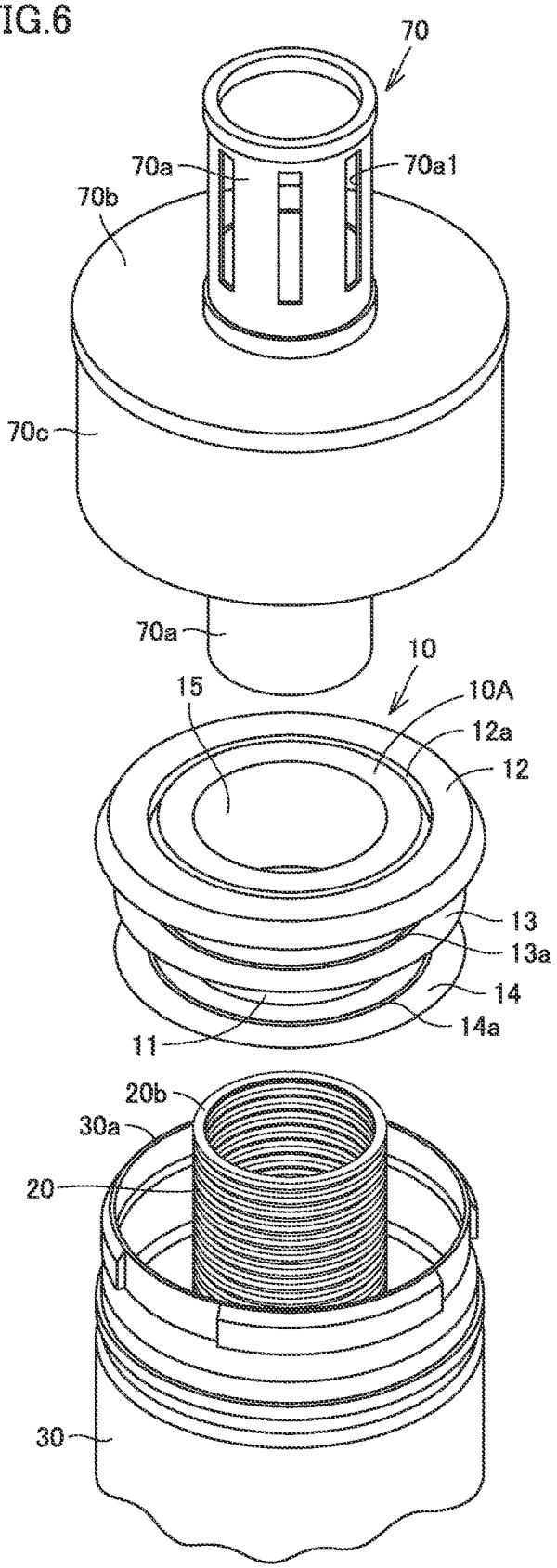
FIG. 6 is a perspective view illustrating a first step in the method for installing the exhaust structure for combustion apparatus according to the first embodiment of the present invention.

As illustrated in FIG. 6, the other end 20*b* of exhaust tube 20 is pulled out of an upper end opening 30*a* of exhaust pipe 30 having a relatively large diameter. After the other end 20*b* of exhaust tube 20 is pulled out of upper end opening 30*a* of exhaust pipe 30, exhaust tube holding member 10 is attached to the outer peripheral surface of exhaust tube 20. The attachment of exhaust tube holding member 10 around exhaust tube 20 is performed by attaching exhaust tube holding member 10 to the outer peripheral surface of exhaust tube 20 from the radial direction of exhaust tube 20. Specifically, exhaust tube 20 is inserted into through hole 15 of exhaust tube holding member 10 so as to attach exhaust tube holding member 10 around exhaust tube 20.

Figure 7:
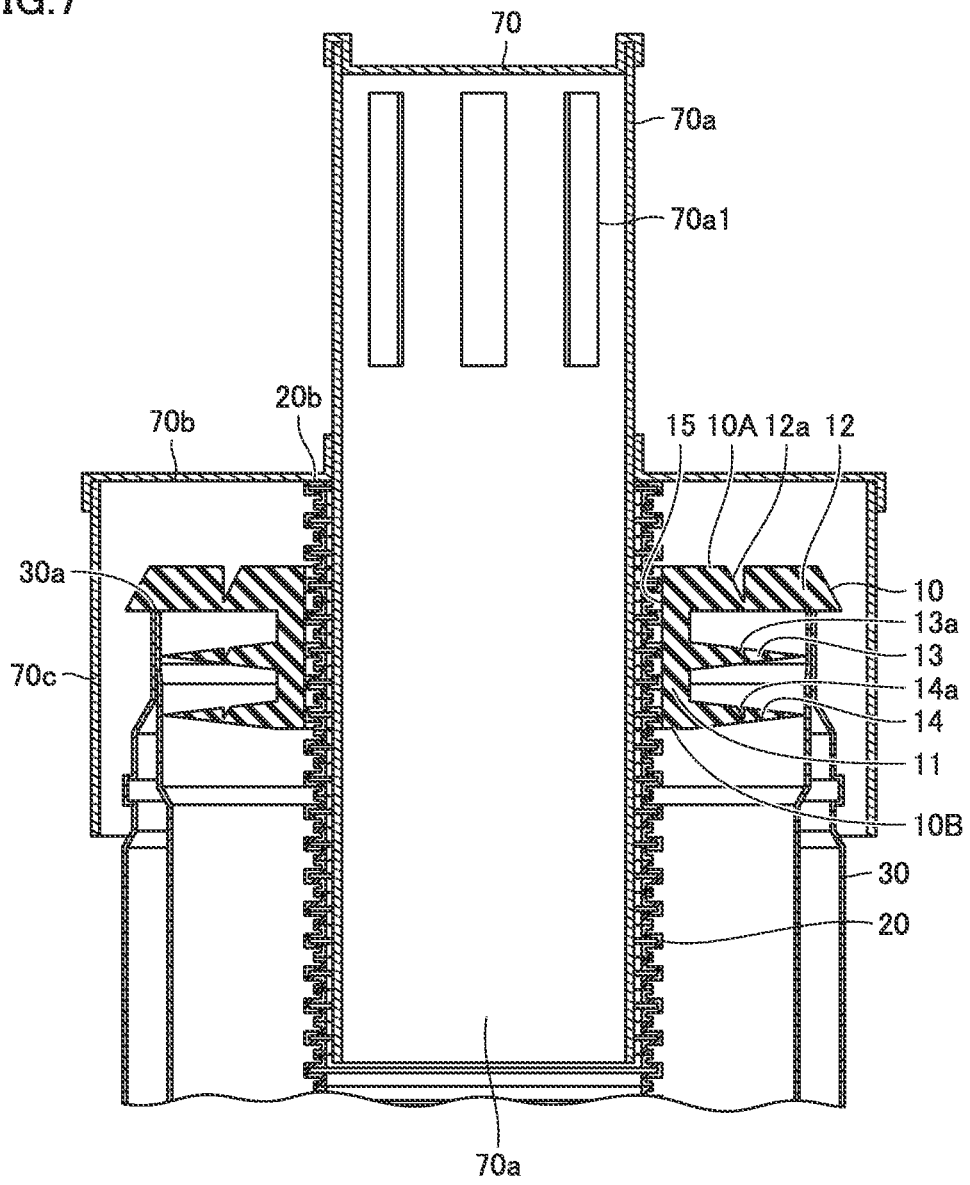
FIG. 7 is a sectional view illustrating a second step in the method for installing the exhaust structure for combustion apparatus according to the first embodiment of the present invention.

As illustrated in FIG. 7, after attaching exhaust tube holding member 10 around exhaust tube 20, the protruding pieces (outward protruding portions) 13 and 14 of exhaust tube holding member 10 are sequentially inserted into exhaust pipe 30. Thus, each of protruding pieces 13 and 14 comes into peripheral contact with the inner peripheral wall surface of exhaust pipe 30. The insertion of exhaust tube holding member 10 into exhaust pipe 30 is performed continuously until flange portion 12 of exhaust tube holding member 10 abuts against upper end opening 30*a* of exhaust pipe 30. Thus, after exhaust tube holding member 10 has been completely inserted into exhaust pipe 30, each of protruding pieces 13 and 14 is in peripheral contact with the inner peripheral wall surface of exhaust pipe 30, and flange portion 12 of exhaust tube holding member 10 abuts against upper end opening 30*a* of exhaust pipe 30.

Thereafter, rain cap 70 is attached to exhaust tube 20. Specifically, discharge member 70*a* of rain cap 70 is inserted into exhaust tube 20 from the other end 20*b* of exhaust tube 20. The insertion of discharge member 70*a* into exhaust tube 20 may be performed continuously until ceiling 70*b* of rain cap 70 abuts against the other end 20*b* of exhaust tube 20. After discharge member 70*a* is inserted into exhaust tube 20, peripheral wall 70*c* of rain cap 70 surrounds the outer peripheral region of exhaust tube holding member 10. Accordingly, exhaust structure for combustion apparatus 100 of the present embodiment is installed in building 200.

Hereinafter, the method of installing the exhaust structure for combustion apparatus of the present embodiment in the case where exhaust pipe 30 has a relatively small diameter (for example, 3 inches) will be described with reference to FIG. 5 and FIGS. 8 to 11. As to those steps in the installation method that will be performed in the same manner as that mentioned above in the case where exhaust pipe 30 has a relatively large diameter, the description thereof will not be repeated.

Figure 8:
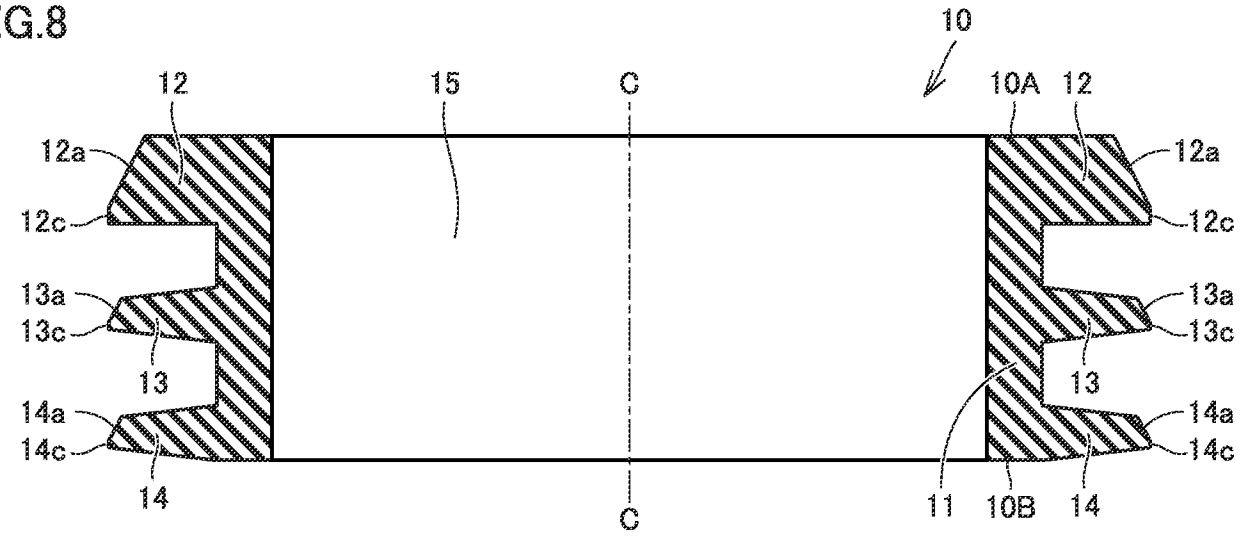
FIG. 8 is a sectional view schematically illustrating the exhaust tube holding member included in the exhaust structure for combustion apparatus after being cut according to the first embodiment of the present invention.

In the case where exhaust pipe 30 is known to have a relatively small diameter at an installation site, as illustrated in FIG. 5, an installation technician may cut exhaust tube holding member 10 by using a pair of scissors or the like (a knife, a cutting tool). The cutting is performed along annular grooves 12*a*, 13*a* and 14*a*. After the cutting, exhaust tube holding member 10 is formed to have such a shape as illustrated in FIG. 8. Note that the cutting of exhaust tube holding member 10 along annular grooves 12*a*, 13*a* and 14*a* may be performed by using a punching tool, or may be performed by hand without using any tool.

As illustrated in FIG. 8, exhaust tube holding member 10 after cutting is different in the outer peripheral shape from the exhaust tube holding member before cutting (FIG. 5). After cutting, flange portion 12 and protruding pieces 13 and 14 in exhaust tube holding member 10 have substantially the same outer diameter. The outer peripheral edge of flange portion 12 includes an inclined surface 12*a* and a cut surface 12*c*. Inclined surface 12*a* is inclined so as to protrude peripherally outward from one end 10A toward the other end 10B. Cut surface 12*c* extends vertically from inclined surface 12*a* toward the side of the other end 10B along the direction of center axis C-C of through hole 15.

The outer peripheral edge of protruding piece 13 includes an inclined surface 13*a* and a cut surface 13*c*. Inclined surface 13*a* is inclined so as to protrude peripherally outward from one end 10A toward the other end 10B. Cut surface 13*c* extends vertically from inclined surface 13*a* toward the side of the other end 10B along the direction of center axis C-C of through hole 15.

The outer peripheral edge of protruding piece 14 includes an inclined surface 14*a* and a cut surface 14*c*. Inclined surface 14*a* is inclined so as to protrude peripherally outward from one end 10A toward the other end 10B. Cut surface 14*c* extends vertically from inclined surface 14*a* toward the side of the other end 10B along the direction of center axis C-C of through hole 15.

Figure 9:
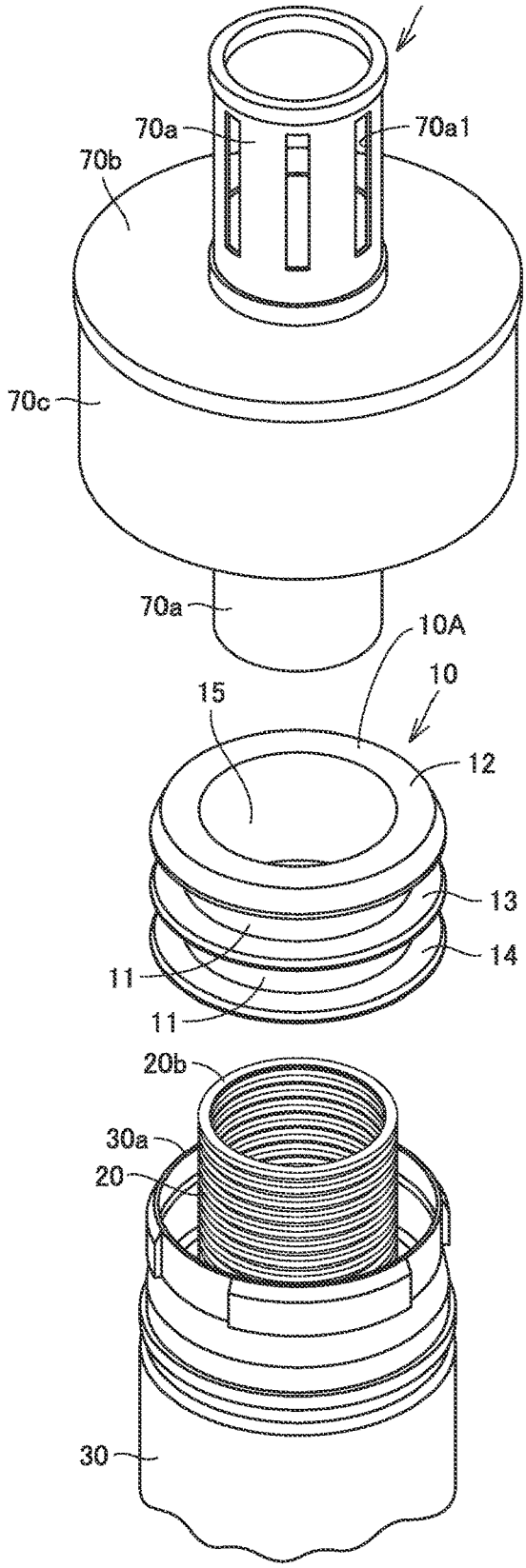
FIG. 9 is a perspective view illustrating a first step in the method for installing the exhaust structure for combustion apparatus after the exhaust tube holding member is cut according to the first embodiment of the present invention.

As illustrated in FIG. 9, after the cutting of exhaust tube holding member 10 is completed, the other end 20*b* of exhaust tube 20 is pulled out of upper end opening 30*a* of exhaust pipe 30 having a relatively small diameter. After the other end 20*b* of exhaust tube 20 is pulled out of upper end opening 30*a* of exhaust pipe 30, exhaust tube holding member 10 is attached to the outer peripheral surface of exhaust tube 20. The attachment of exhaust tube holding member 10 around exhaust tube 20 is performed by attaching exhaust tube holding member 10 to the outer peripheral surface of exhaust tube 20 from the radial direction of exhaust tube 20. Specifically, exhaust tube 20 is inserted into through hole 15 of exhaust tube holding member 10 so as to attach exhaust tube holding member 10 around exhaust tube 20.

Figure 10:
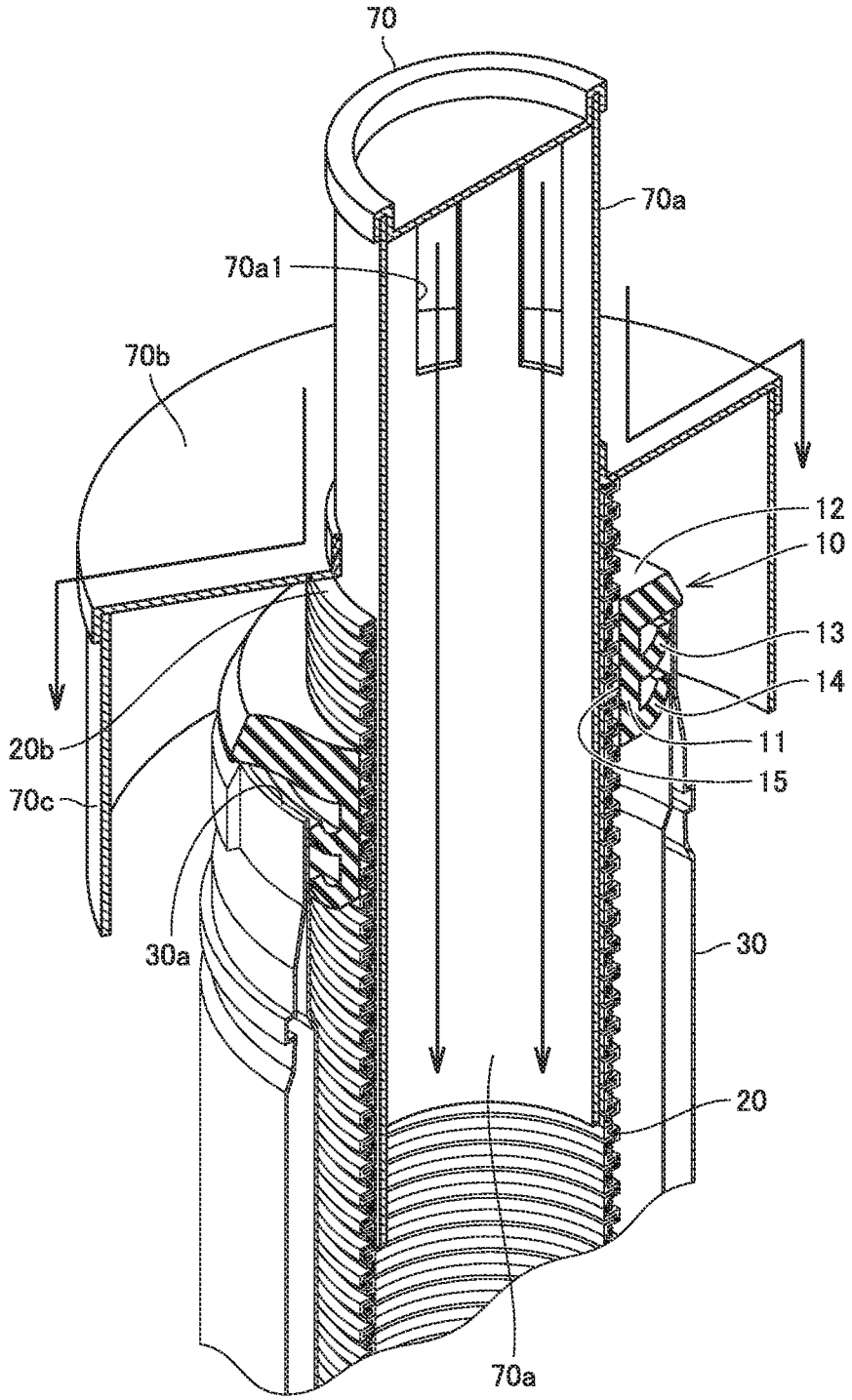
FIG. 10 is a cross-sectional perspective view of a region II in FIG. 1 for the purpose of illustrating a second step in the method for installing the exhaust structure for combustion apparatus after the exhaust tube holding member is cut according to the first embodiment of the present invention.
Figure 11:
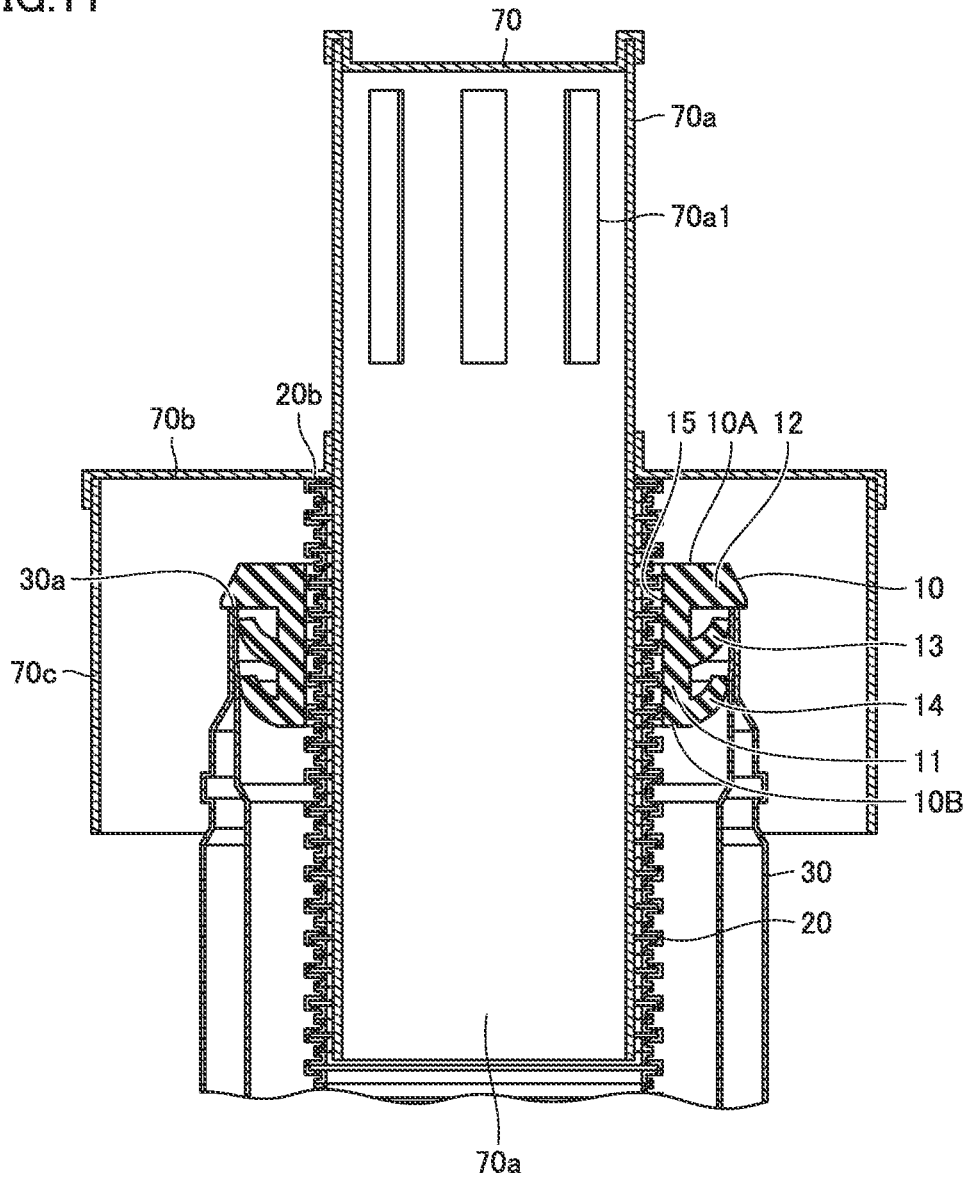
FIG. 11 is a sectional view illustrating a second step in the method for installing the exhaust structure for combustion apparatus after the exhaust tube holding member is cut according to the first embodiment of the present invention.

As illustrated in FIGS. 10 and 11, after attaching exhaust tube holding member 10 around exhaust tube 20, the protruding pieces (outward protruding portions) 13 and 14 of exhaust tube holding member 10 are sequentially inserted into exhaust pipe 30. Thus, each of protruding pieces 13 and 14 comes into peripheral contact with the inner peripheral wall surface of exhaust pipe 30. The insertion of exhaust tube holding member 10 into exhaust pipe 30 is performed continuously until flange portion 12 of exhaust tube holding member 10 abuts against upper end opening 30*a* of exhaust pipe 30. Thus, after exhaust tube holding member 10 has been completely inserted into exhaust pipe 30, each of protruding pieces 13 and 14 is in peripheral contact with the inner peripheral wall surface of exhaust pipe 30, and flange portion 12 of exhaust tube holding member 10 abuts against upper end opening 30*a* of exhaust pipe 30.

Thereafter, rain cap 70 is attached to exhaust tube 20 in the same manner as described above in the case where exhaust pipe 30 has a relatively large diameter. Thereby, exhaust structure for combustion apparatus 100 of the present embodiment is installed in building 200.

In the description above, it has been described that exhaust tube holding member 10 is firstly cut and then attached to exhaust tube 20, it is acceptable that exhaust tube holding member 10 is firstly attached to exhaust tube 20 and is cut thereafter.

The effects of the present embodiment will be described hereinafter.

According to the present embodiment, since flange portion 12 is formed with annular groove 12*a*, it is easy to cut flange portion 12 along annular groove 12*a*, making it easy to modify the radial dimension of flange portion 12. Thereby, it is possible to modify the radial dimension of flange portion 12 at an installation site, enabling a simple and easy installation to deal with any exhaust pipe with different sizes and shapes.

Since the same exhaust tube holding member 10 can be used to deal with both the installation of exhaust pipe 30 having a relatively large diameter and the installation of exhaust pipe 30 having a relatively smaller diameter, it is possible to prevent the installation technician from bringing a wrong-sized exhaust tube holding member to the installation site.

Since annular groove 12*a* is formed concentrically with through hole 15, it is easy to hold exhaust pipe 30 concentrically with exhaust tube 20 which has been inserted into through hole 15.

Since the outward protruding portions (protruding pieces 13 and 14) are respectively formed with annular grooves 13*a* and 14*a* surrounding through hole 15, it is easy to cut protruding pieces 13 and 14 along annular grooves 13*a* and 14*a*, respectively, making it easy to modify the radial dimension of each of protruding pieces 13 and 14. Thus, it is possible to modify the radial dimension of each of protruding pieces 13 and 14 at an installation site, enabling a simple and easy installation to deal with any exhaust pipe with different sizes and shapes.

Since annular groove 12*a* has the same radius as annular grooves 13*a* and 14*a* in planar view, it is possible to efficiently cut flange portion 12 along annular groove 12*a* and efficiently cut protruding pieces 13 and 14 along annular grooves 13*a* and 14*a*, respectively.

As illustrated in FIG. 5, annular groove 12*a* has depth T1*a* at least half of thickness T1 of flange portion 12. Thereby, it is easy to cut flange portion 12 along annular groove 12*a* at an installation site. For example, the outer peripheral portion of flange portion 12 may be easily cut along annular groove 12*a* without using a tool.

In the installation of the exhaust structure for combustion apparatus, the cutting of flange portion 12 along annular groove 12*a* is performed prior to the attaching of exhaust tube holding member 10 to the outer peripheral surface of exhaust tube 20. Thereby, it is possible to cut flange portion 12 in a free state before the attaching of exhaust tube holding member 10 to exhaust tube 20, allowing the cutting to be performed more accurately.

The cutting of flange portion 12 along annular groove 12*a* may be performed after the attaching of exhaust tube holding member 10 on the outer circumferential surface of exhaust tube 20. Thereby, it is possible to cut flange portion 12 in a stable state after the attaching of exhaust tube holding member 10 to exhaust tube 20, allowing the cutting to be performed more stably.

Second Embodiment

Figure 12:
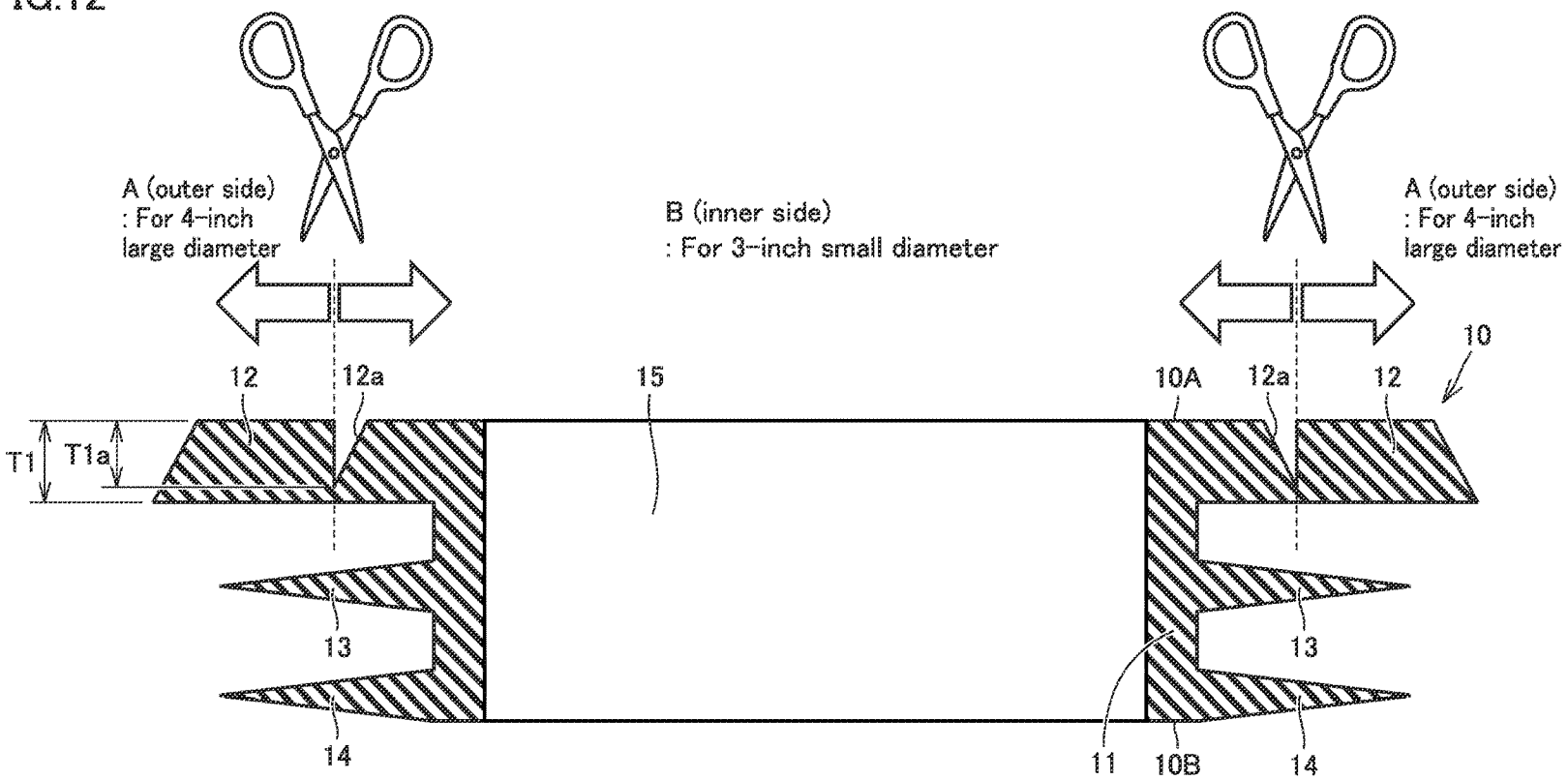
FIG. 12 is a sectional view schematically illustrating the configuration of an exhaust tube holding member included in the exhaust structure for combustion apparatus according to a second embodiment of the present invention.

As illustrated in FIG. 12, exhaust tube holding member 10 in the second embodiment is different from that in the first embodiment illustrated in FIGS. 3 to 5 in that no annular groove is formed on protruding pieces (outward protruding portions) 13 and 14.

In exhaust tube holding member 10 of the present embodiment, only the flange portion is formed with annular groove 12*a* similar to that in the first embodiment. Annular groove 12*a* is formed on a surface of flange portion 12 closer to the side of one end 10A so as to surround through hole 15. Annular groove 12*a* is formed to have for example a circular shape, and is arranged concentrically with through hole 15 in planar view. Annular groove 12*a* has depth T1*a* at least half of thickness T1 of flange portion 12.

Since the other members of exhaust tube holding member 10 in the present embodiment are substantially the same as those in the first embodiment, the same reference numerals will be assigned to the same members, and the description thereof will not be repeated.

According to the method for installing the exhaust structure for combustion apparatus in the present embodiment, in the case where exhaust pipe 30 has a relatively large diameter (for example, 4 inches), exhaust tube holding member 10 is used in the installation without cutting. In other words, when exhaust tube holding member 10 is used in the installation without cutting, similar to the first embodiment illustrated in FIGS. 6 and 7, after exhaust tube 20 is inserted across through hole 15, protruding pieces 13 and 14 are sequentially inserted into exhaust pipe 30 until the surface of flange portion 12 closer to the side of the other end 10B comes into contact with upper end opening 30*a* of exhaust pipe 30.

On the other hand, in the case where exhaust pipe 30 has a relatively small diameter (for example, 3 inches), exhaust tube holding member 10 is used in the installation after flange portion 12 is cut along annular groove 12*a* as illustrated in FIG. 12. At this time, none of protruding pieces 13 and 14 is cut in particular. Thus, under the condition where only flange portion 12 has been cut, similar to the first embodiment illustrated in FIGS. 9 to 11, after exhaust tube 20 is inserted into through hole 15, protruding pieces 13 and 14 are sequentially inserted into exhaust pipe 30 until the surface of flange portion 12 closer to the side of the other end 10B comes into contact with upper end opening 30*a* of exhaust pipe 30.

Each of protruding pieces 13 and 14 is configured so that the thickness becomes thinner from the bottom end (from the side of the inner peripheral surface) toward the distal end (toward the side of the outer peripheral surface). Thus, the distal end of each of protruding pieces 13 and 14 is more deformable than the bottom end thereof. Accordingly, when inserting protruding pieces 13 and 14 into exhaust pipe 30, the distal end of each of protruding pieces 13 and 14 deforms easily, abutting peripherally against the inner peripheral wall surface of exhaust pipe 30.

Since the other steps of the installation method are substantially the same as those in the first embodiment, the description thereof will not be repeated.

According to the present embodiment mentioned above, none of protruding pieces 13 and 14 is formed with an annular groove, and instead, each of protruding pieces 13 and 14 is configured so that the thickness becomes thinner from the bottom end (from the side of the inner peripheral surface) toward the distal end (toward the side of the outer peripheral surface). Thus, the distal end of each of protruding pieces 13 and 14 is more deformable than the bottom end thereof. Accordingly, when inserting protruding pieces 13 and 14 into exhaust pipe 30 having a relatively small diameter, the distal end of each of protruding pieces 13 and 14 deforms easily, abutting peripherally against the inner peripheral wall surface of exhaust pipe 30 so as to occlude the interior space of exhaust pipe 30.

According to the present embodiment, it is also possible to obtain the same effects as that in the first embodiment.

Third Embodiment

Figure 13:
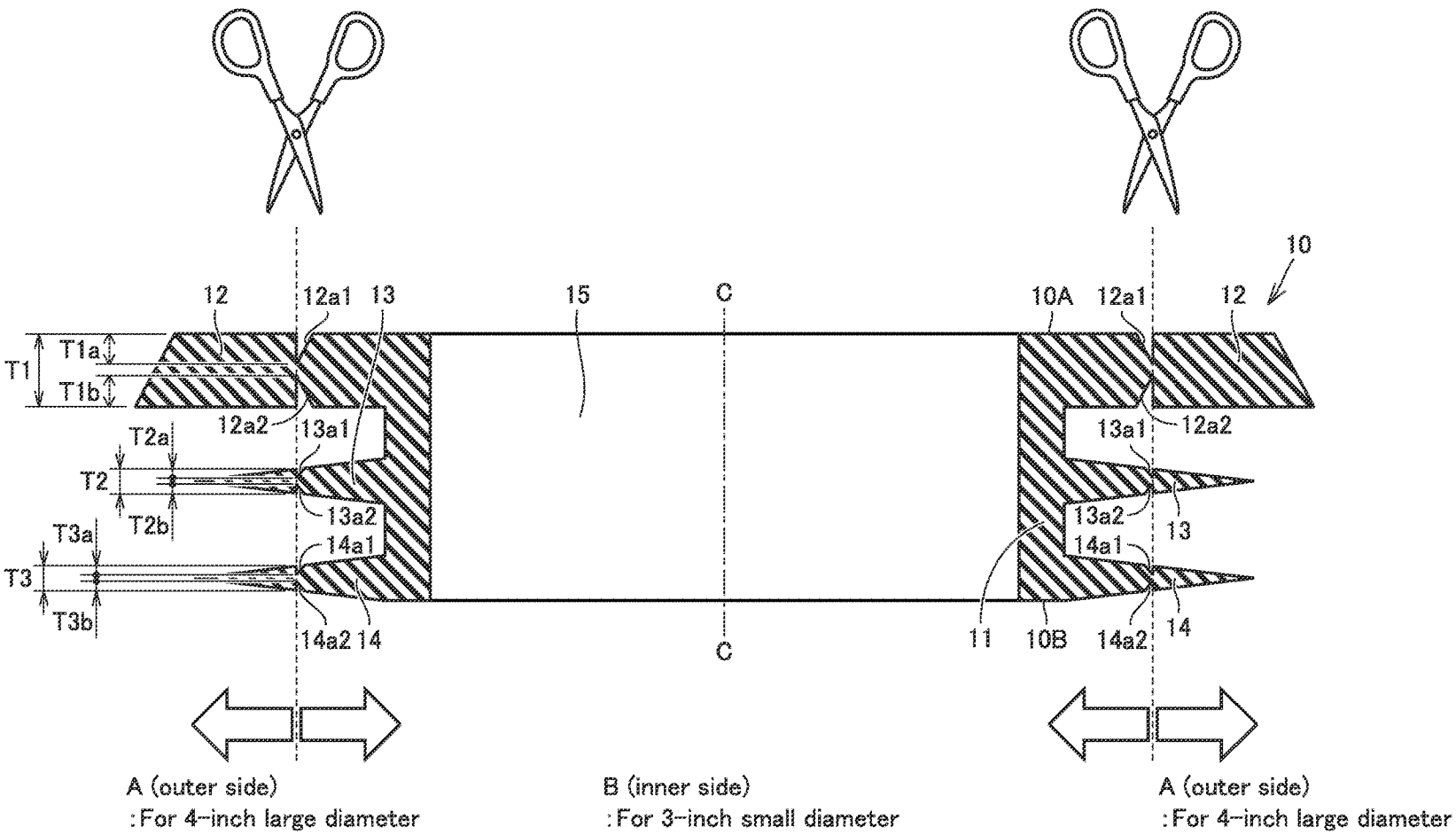
FIG. 13 is a sectional view schematically illustrating the configuration of an exhaust tube holding member included in the exhaust structure for combustion apparatus according to a third embodiment of the present invention.

As illustrated in FIG. 13, exhaust tube holding member 10 in the third embodiment is different from that in the first embodiment illustrated in FIGS. 3 to 5 in different configuration of each of annular grooves 12*a*, 13*a* and 14*a*.

Annular groove 12*a* in the present embodiment includes a first groove portion 12*a*1 formed on one surface of flange portion 12 closer to one end 10A, and a second groove portion 12*a*2 formed on the other surface of flange portion 12 closer to the other end 10B. First groove portion 12*a*1 and second groove portion 12*a*2 are formed peripherally opposite to each other in the direction of central axis C-C of through hole 15. The sum of depth T1*a* of first groove portion 12*a*1 and depth T1*b* of second groove portion 12*a*2 is at least half of thickness T1 of flange portion 12.

Annular groove 13*a* in the present embodiment includes a first groove portion 13*a*1 formed on one surface of protruding piece 13 closer to one end 10A, and a second groove portion 13*a*2 formed on the other surface of protruding piece 13 closer to the other end 10B. First groove portion 13*a*1 and second groove portion 13*a*2 are formed peripherally opposite to each other in the direction of central axis C-C of through hole 15. The sum of depth T2*a* of first groove portion 13*a*1 and depth T2*b* of second groove portion 13*a*2 is at least half of thickness T2 of protruding piece 13.

Annular groove 14*a* in the present embodiment includes a first groove portion 14*a*1 formed on one surface of protruding piece 14 closer to one end 10A, and a second groove portion 14*a*2 formed on the other surface of protruding piece 14 closer to the other end 10B. First groove portion 14*a*1 and second groove portion 14*a*2 are formed peripherally opposite to each other in the direction of central axis C-C of through hole 15. The sum of depth T3*a* of first groove portion 14*a*1 and depth T3*b* of second groove portion 14*a*2 is at least half of thickness T3 of protruding piece 14.

Since the other members of exhaust tube holding member 10 in the present embodiment are substantially the same as those in the first embodiment, the same reference numerals will be assigned to the same members, and the description thereof will not be repeated.

According to the method for installing the exhaust structure for combustion apparatus in the present embodiment, in the case where exhaust pipe 30 has a relatively large diameter (for example, 4 inches), exhaust tube holding member 10 is used in the installation without cutting. In other words, when exhaust tube holding member 10 is used in the installation without cutting, similar to the first embodiment illustrated in FIGS. 6 and 7, after exhaust tube 20 is inserted across through hole 15, protruding pieces 13 and 14 are sequentially inserted into exhaust pipe 30 until the surface of flange portion 12 closer to the side of the other end 10B comes into contact with upper end opening 30*a* of exhaust pipe 30.

On the other hand, in the case where exhaust pipe 30 has a relatively large diameter (for example, 3 inches), exhaust tube holding member 10 is used in the installation after flange portion 12 is cut along annular grooves 12*a*1 and 12*a*2, protruding piece 13 is cut along annular grooves 13*a*1 and 13*a*2, and protruding piece 14 is cut along annular grooves 14*a*1 and 14*a*2 as illustrated in FIG. 13. Thus, under the condition where flange portion 12, protruding piece 13 and protruding piece 14 have been cut, similar to the first embodiment illustrated in FIGS. 9 to 11, after exhaust tube 20 is inserted across through hole 15, protruding pieces 13 and 14 are sequentially inserted into exhaust pipe 30 until the surface of flange portion 12 closer to the side of the other end 10B comes into contact with upper end opening 30*a* of exhaust pipe 30.

Figure 14:
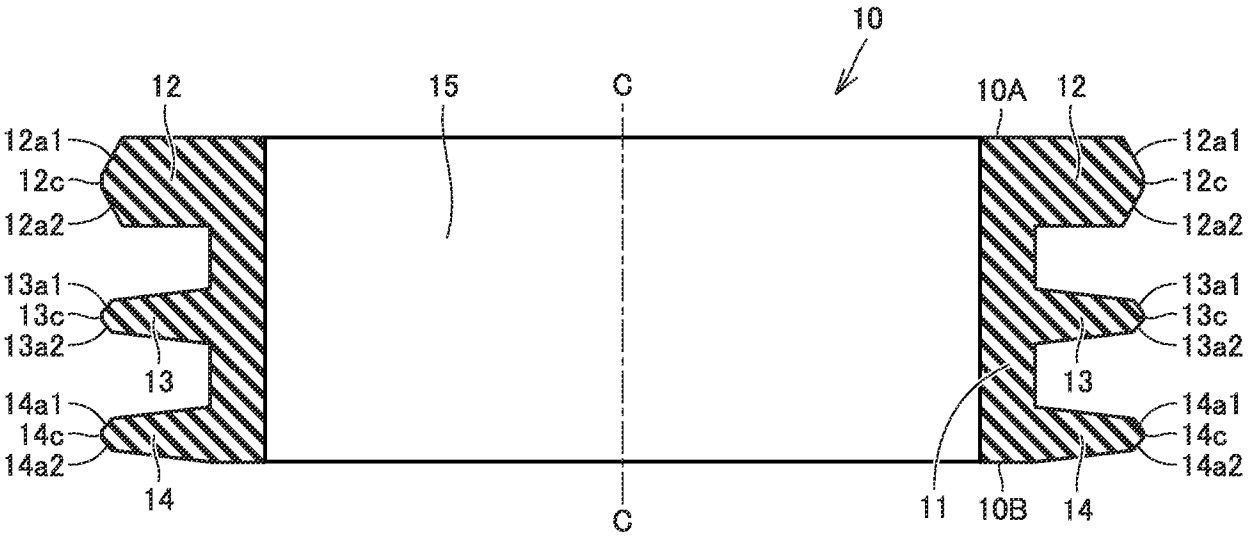
FIG. 14 is a sectional view schematically illustrating the exhaust tube holding member included in the exhaust structure for combustion apparatus after being cut according to the third embodiment of the present invention.

As illustrated in FIG. 14, exhaust tube holding member 10 after cutting is different in the outer peripheral shape from the exhaust tube holding member before cutting (FIG. 13) before cutting. After cutting, flange portion 12 and protruding pieces 13 and 14 in exhaust tube holding member 10 have substantially the same outer diameter. The outer peripheral edge of flange portion 12 includes an inclined surface 12*a*1, a cut surface 12*c* and an inclined surface 12*a*2. Inclined surface 12*a*1 is inclined so as to protrude peripherally outward from one end 10A toward the other end 10B. Inclined surface 12*a*2 is inclined so as to protrude peripherally outward from the other end 10B toward one end 10A. Cut surface 12*c* is located between inclined surface 12*a*1 and inclined surface 12*a*2, and extends vertically from the side of one end 10A toward the side of the other end 10B along the direction of center axis C-C of through hole 15.

The outer peripheral edge of protruding piece 13 includes an inclined surface 13*a*1, a cut surface 13*c* and an inclined surface 13*a*2. Inclined surface 13*a*1 is inclined so as to protrude peripherally outward from one end 10A toward the other end 10B. Inclined surface 13*a*2 is inclined so as to protrude peripherally outward from the other end 10B toward one end 10A. Cut surface 13*c* is located between inclined surface 13*a*1 and inclined surface 13*a*2, and extends vertically from the side of one end 10A toward the side of the other end 10B along the direction of center axis C-C of through hole 15.

The outer peripheral edge of protruding piece 14 includes an inclined surface 14*a*1, a cut surface 14*c* and an inclined surface 14*a*2. Inclined surface 14*a*1 is inclined so as to protrude peripherally outward from one end 10A toward the other end 10B. Inclined surface 14*a*2 is inclined so as to protrude peripherally outward from the other end 10B toward one end 10A. Cut surface 14*c* is located between inclined surface 14*a*1 and inclined surface 14*a*2, and extends vertically from the side of one end 10A toward the side of the other end 10B along the direction of center axis C-C of through hole 15.

Since the other steps of the installation method are substantially the same as those in the first embodiment, the description thereof will not be repeated.

According to the present embodiment as mentioned above, since first groove portion 12*a*1 and second groove portion 12*a*2 are formed peripherally opposite to each other in the direction of central axis C-C of through hole 15. Thereby, the cutting marks are formed on both surfaces of flange portion 12, it is possible to cut flange portion 12 from either the front surface or the back surface in accordance with installation requirements.

Similarly in the case of protruding pieces 13 and 14, since first groove portion 13*a*1 and second groove portion 13*a*2 are formed peripherally opposite to each other in the direction of central axis C-C of through hole 15, and first groove portion 14*a*1 and second groove portion 14*a*2 are formed peripherally opposite to each other in the direction of central axis C-C of through hole 15. Thereby, the cutting marks are formed on both surfaces of each of protruding pieces 13 and 14, it is possible to cut protruding pieces 13 and 14 from either the front surface or the back surface in accordance with installation requirements.

Since the sum of depth T1*a* of first groove portion 12*a*1 and depth T1*b* of second groove portion 12*a*2 is at least half of thickness T1 of flange portion 12, it is easier to cut flange portion 12 along first groove portion 12*a*1 and second groove portion 12*a*2 at an installation site. For example, the outer peripheral portion of flange portion 12 may be easily cut along annular groove 12*a* without using a tool.

Similarly in the case of protruding piece 13, since the sum of depth T2*a* of first groove portion 13*a*1 and depth T2*b* of second groove portion 13*a*2 is at least half of thickness T2 of protruding piece 13, it is easier to cut protruding piece 13 along first groove portion 13*a*1 and second groove portion 13*a*2 at an installation site. For example, the outer peripheral portion of protruding piece 13 may be easily cut along annular groove 13*a* without using a tool.

Similarly in the case of protruding piece 14, since the sum of depth T3*a* of first groove portion 14*a*1 and depth T3*b* of second groove portion 14*a*2 is at least half of thickness T3 of protruding piece 14, it is easier to cut protruding piece 14 along first groove portion 14*a*1 and second groove portion 14*a*2 at an installation site. For example, the outer peripheral portion of protruding piece 14 may be easily cut along annular groove 14*a* without using a tool.

According to the present embodiment, it is also possible to obtain the same effects as that in the first embodiment.

Fourth Embodiment

Figure 15:
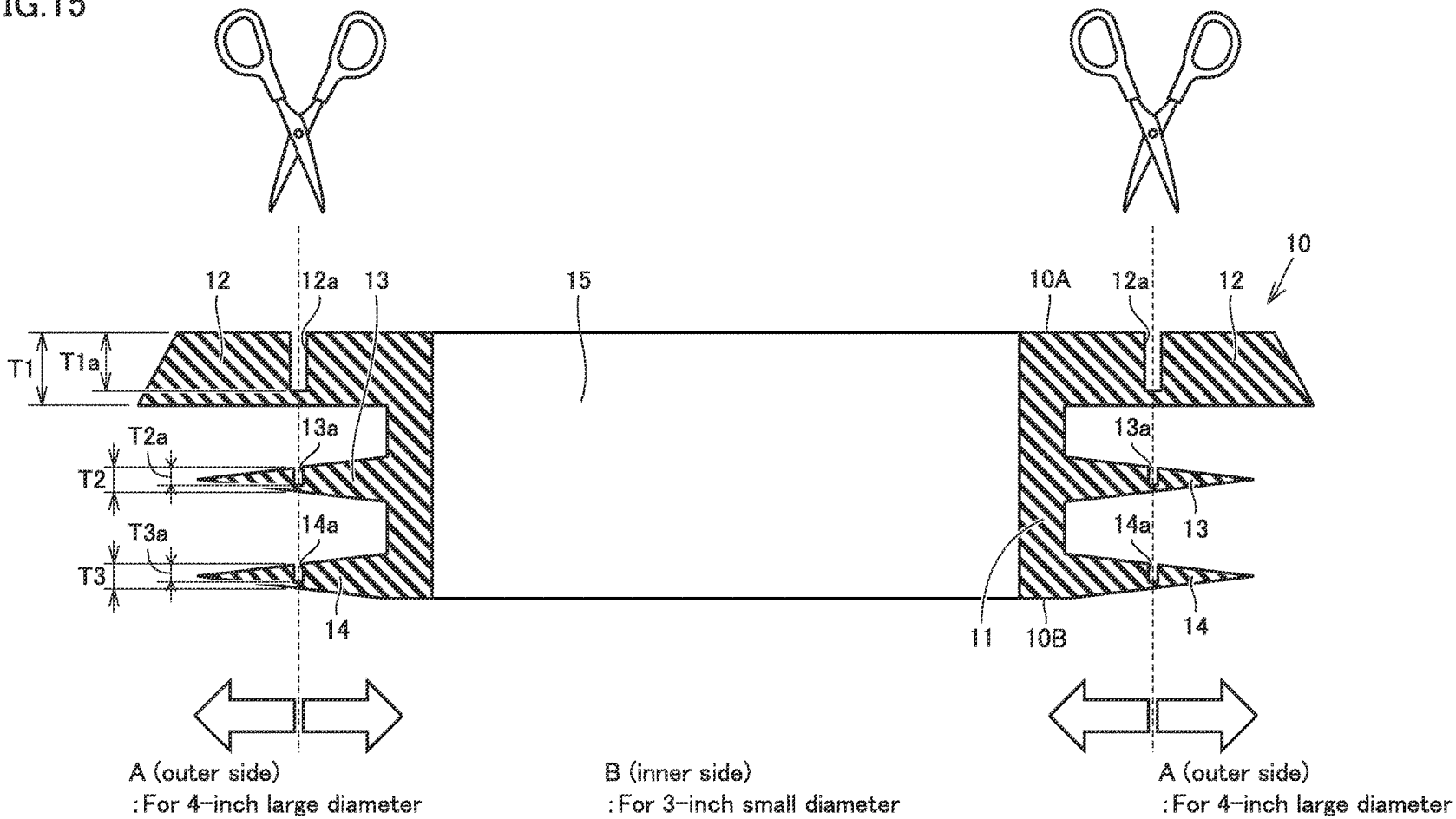
FIG. 15 is a sectional view schematically illustrating the configuration of an exhaust tube holding member included in the exhaust structure for combustion apparatus according to a fourth embodiment of the present invention.

As illustrated in FIG. 15, exhaust tube holding member 10 in the fourth embodiment is different from that in the first embodiment illustrated in FIGS. 3 to 5 in different shape of each of annular grooves 12*a*, 13*a* and 14*a*. Each of annular grooves 12*a*, 13*a* and 14*a* in the present embodiment is formed into a rectangular shape in cross section (a U-shaped groove) as illustrated in FIG. 15.

Figure 16:
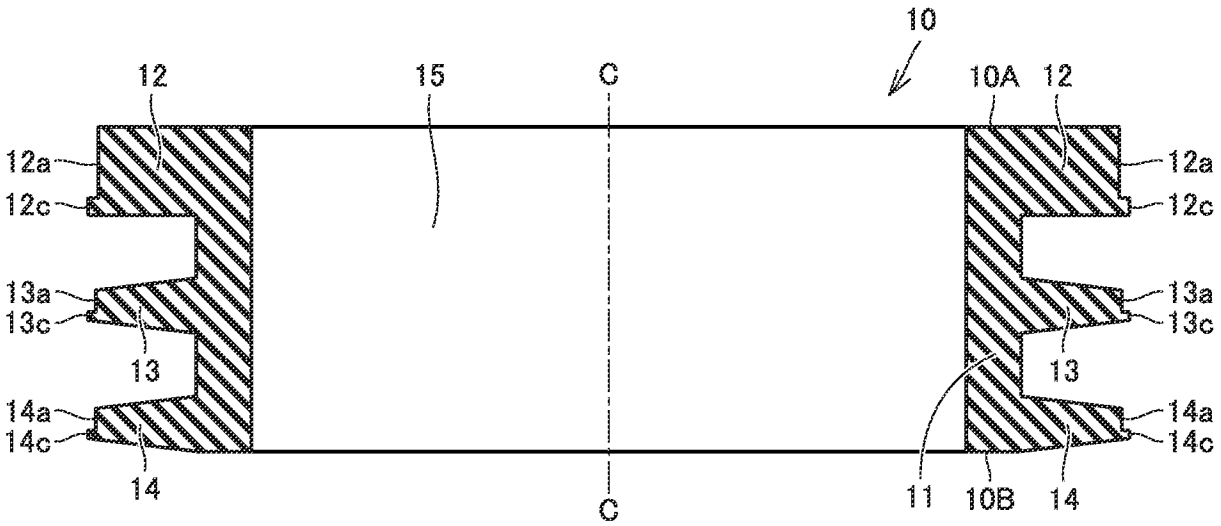
FIG. 16 is a sectional view schematically illustrating the exhaust tube holding member included in the exhaust structure for combustion apparatus after being cut according to the fourth embodiment of the present invention.

As illustrated in FIG. 16, when cutting flange portion 12 along annular groove 12*a*, the outer peripheral edge of flange portion 12 is formed to include a groove inner peripheral surface 12*a* and a cut surface 12*c*. Each of groove inner peripheral surface 12*a* and cut surface 12*c* extends from the side of one end 10A toward the side of the other end 10B along the direction of central axis C-C of through hole 15. Cut surface 12*c* protrudes peripherally outward outer than groove inner peripheral surface 12*a*, and thereby forms a step between cut surface 12*c* and groove inner peripheral surface 12*a*.

When cutting protruding piece 13 along annular groove 13*a*, the outer peripheral edge of protruding piece 13 is formed to include a groove inner peripheral surface 13*a* and a cut surface 13*c*. Each of groove inner peripheral surface 13*a* and cut surface 13*c* extends from the side of one end 10A toward the side of the other end 10B along the direction of central axis C-C of through hole 15. Cut surface 13*c* protrudes peripherally outward outer than groove inner peripheral surface 13*a*, and thereby forms a step between cut surface 13*c* and groove inner peripheral surface 13*a*.

When cutting protruding piece 14 along annular groove 14*a*, the outer peripheral edge of protruding piece 14 is formed to include a groove inner peripheral surface 14*a* and a cut surface 14*c*. Each of groove inner peripheral surface 14*a* and cut surface 14*c* extends from the side of one end 10A toward the side of the other end 10B along the direction of central axis C-C of through hole 15. Cut surface 14*c* protrudes peripherally outward outer than groove inner peripheral surface 14*a*, and thereby forms a step between cut surface 14*c* and groove inner peripheral surface 14*a*.

Since the other members of exhaust tube holding member 10 in the present embodiment are substantially the same as those in the first embodiment, the same reference numerals will be assigned to the same members, and the description thereof will not be repeated.

Further, since the installation method is substantially the same as that in the first embodiment, the description thereof will not be repeated.

According to the present embodiment, it is also possible to obtain the same effects as that in the first embodiment.

Fifth Embodiment

Figure 17:
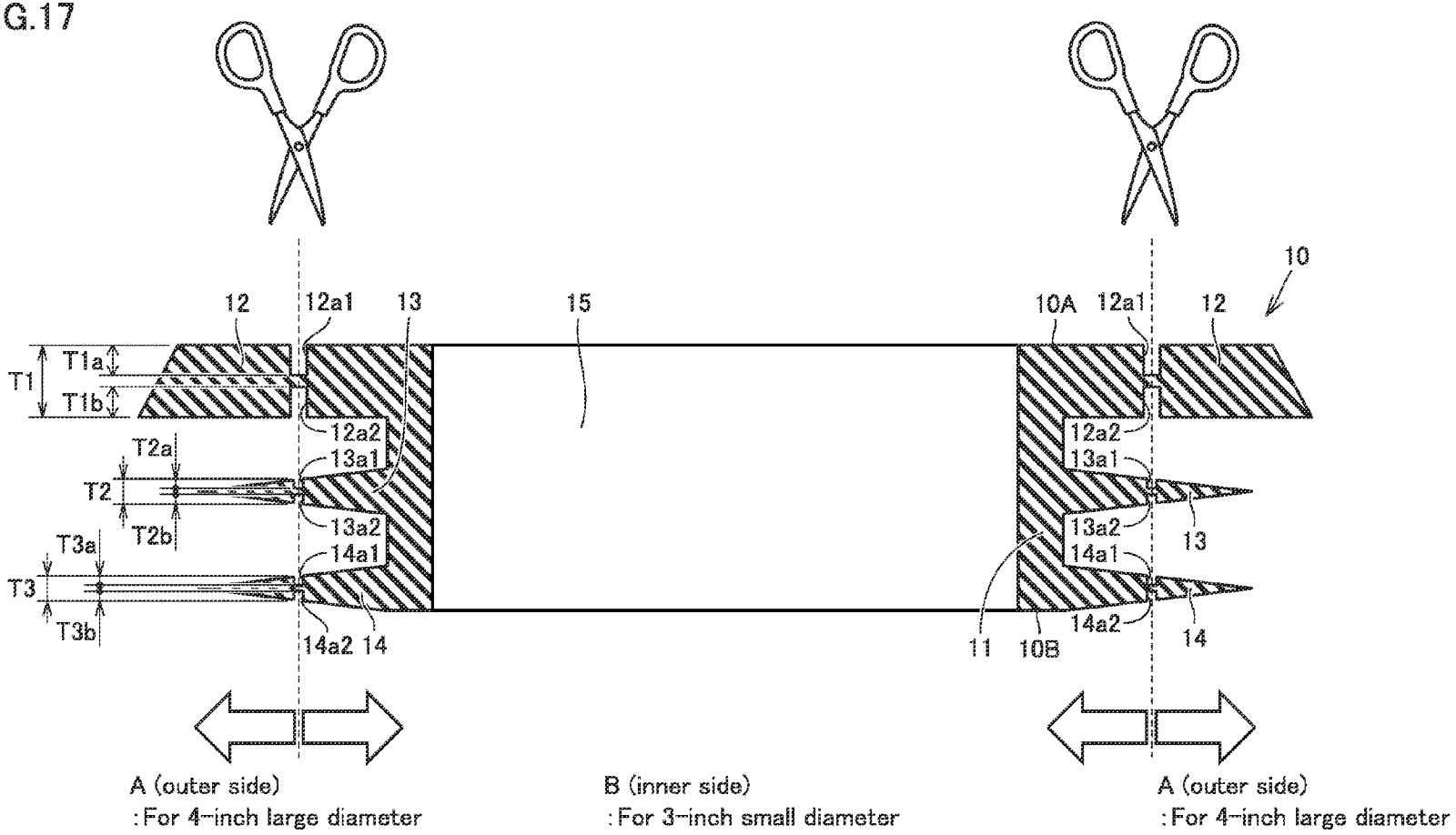
FIG. 17 is a sectional view schematically illustrating the configuration of an exhaust tube holding member included in the exhaust structure for combustion apparatus according to a fifth embodiment of the present invention.

As illustrated in FIG. 17, exhaust tube holding member 10 in the fifth embodiment is different from that in the third embodiment illustrated in FIGS. 13 and 14 in different shape of each of first groove portions 13*a*1 and 14*a*1 and second groove portions 13*a*2 and 14*a*2. Each of first groove portions 13*a*1 and 14*a*1 and second groove portions 13*a*2 and 14*a*2 in the present embodiment is formed into a rectangular shape in cross section as illustrated in FIG. 17.

Figure 18:
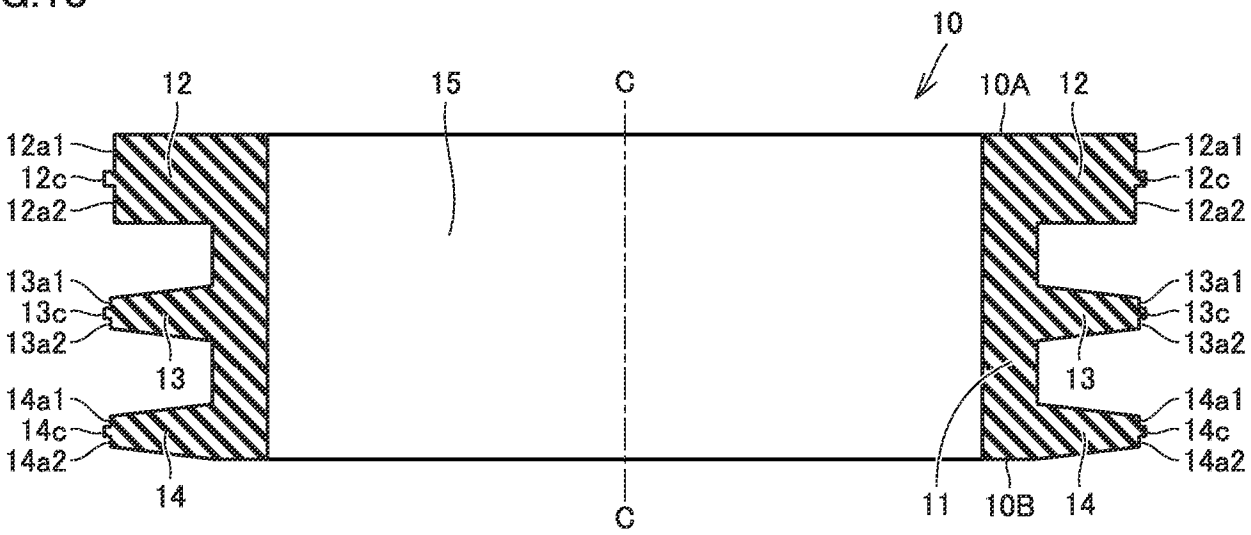
FIG. 18 is a sectional view schematically illustrating the exhaust tube holding member included in the exhaust structure for combustion apparatus after being cut according to the fifth embodiment of the present invention.

As illustrated in FIG. 18, when cutting flange portion 12 along first groove portion 12*a*1 and second groove portion 12*a*2, the outer peripheral edge of flange portion 12 is formed to include a first groove inner peripheral surface 12*a*1, a cut surface 12*c*, and a second groove portion inner peripheral surface 12*a*2. Each of first groove inner peripheral surface 12*a*1, cut surface 12*c*, and second groove portion inner peripheral surface 12*a*2 extends from the side of one end 10A toward the side of the other end 10B along the direction of central axis C-C of through hole 15. Cut surface 12*c* is located between first groove inner peripheral surface 12*a*1 and second groove portion inner peripheral surface 12*a*2. Cut surface 12*c* protrudes peripherally outward outer than both first groove inner peripheral surface 12*a*1 and second groove portion inner peripheral surface 12*a*2, and thereby forms a step between cut surface 12*c* and first groove inner peripheral surface 12*a*1 and a step between cut surface 12*c* and second groove portion inner peripheral surface 12*a*2.

When cutting protruding piece 13 along first groove portion 13*a*1 and second groove portion 13*a*2, the outer peripheral edge of protruding piece 13 is formed to include a first groove inner peripheral surface 13*a*1, a cut surface 13*c*, and a second groove portion inner peripheral surface 13*a*2. Each of first groove inner peripheral surface 13*a*1, cut surface 13*c*, and second groove portion inner peripheral surface 13*a*2 extends from the side of one end 10A toward the side of the other end 10B along the direction of central axis C-C of through hole 15. Cut surface 13*c* is located between first groove inner peripheral surface 13*a*1 and second groove portion inner peripheral surface 13*a*2. Cut surface 13*c* protrudes peripherally outward outer than both first groove inner peripheral surface 13*a*1 and second groove portion inner peripheral surface 13*a*2, and thereby forms a step between cut surface 13*c* and first groove inner peripheral surface 13*a*1 and a step between cut surface 13*c* and second groove portion inner peripheral surface 13*a*2.

When cutting protruding piece 14 along first groove portion 14*a*1 and second groove portion 14*a*2, the outer peripheral edge of protruding piece 14 is formed to include a first groove inner peripheral surface 14*a*1, a cut surface 14*c*, and a second groove portion inner peripheral surface 14*a*2. Each of first groove inner peripheral surface 14*a*1, cut surface 14*c*, and second groove portion inner peripheral surface 14*a*2 extends from the side of one end 10A toward the side of the other end 10B along the direction of central axis C-C of through hole 15. Cut surface 14*c* is located between first groove inner peripheral surface 14*a*1 and second groove portion inner peripheral surface 14*a*2. Cut surface 14*c* protrudes peripherally outward outer than both first groove inner peripheral surface 14*a*1 and second groove portion inner peripheral surface 14*a*2, and thereby forms a step between cut surface 14*c* and first groove inner peripheral surface 14*a*1 and a step between cut surface 14*c* and second groove portion inner peripheral surface 14*a*2.

Since the other members of exhaust tube holding member 10 in the present embodiment are substantially the same as those in the third embodiment, the same reference numerals will be assigned to the same members, and the description thereof will not be repeated.

Further, since the installation method is substantially the same as that in the third embodiment, the description thereof will not be repeated.

According to the present embodiment, it is also possible to obtain the same effects as that in the first embodiment and the third embodiment.

Figure 19A:
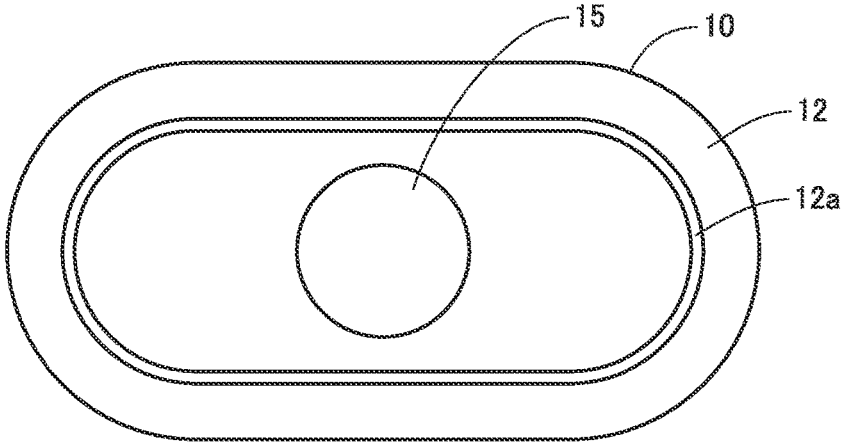
FIG. 19A illustrates that the flange portion of the exhaust tube holding member both have an oval shape in planar view.
Figure 19B:
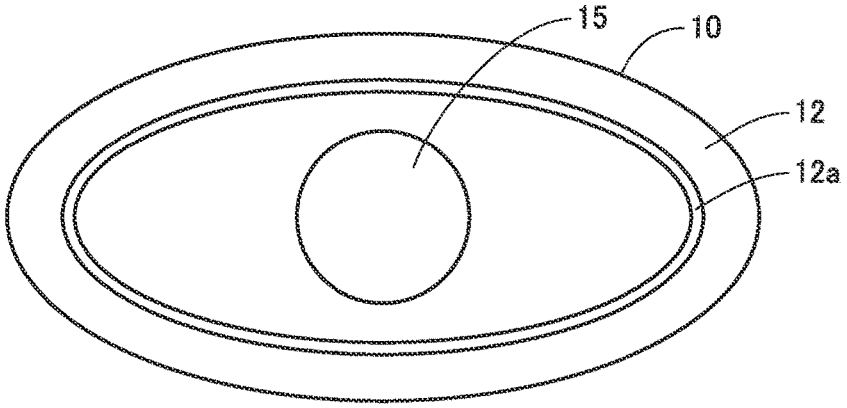
FIG. 19B illustrates that the flange portion of the exhaust tube holding member both have an elliptical shape in planar view.

In the first to fifth embodiments mentioned above, flange portion 12 and the outward protruding portions (protruding pieces 13 and 14) of exhaust tube holding member 10 are described as having a perfect circular shape in planar view, but the shape of each of flange portion 12 and the outward protruding portions (protruding pieces 13 and 14) in planar view is not limited thereto. Each of flange portion 12 and the outward protruding portions (protruding pieces 13 and 14) in planar view may have an oval shape as illustrated in FIG. 19A or an elliptical shape as illustrated in FIG. 19B, which makes it easy to support flange portion 12 on exhaust pipe 30 formed with upper end opening 30*a* having an oval shape or an elliptical shape.

Combustion Apparatus

Hereinafter, the configuration of combustion apparatus 80 used in exhaust structure for combustion apparatus 100 mentioned above will be described with reference to FIGS. 20 and 21.

As described in the above, combustion apparatus 80 used in the above exhaust structure for combustion apparatus 100 may be a water heater of a latent heat recovery type adapted to an exhaust suction and combustion system.

Figure 20:
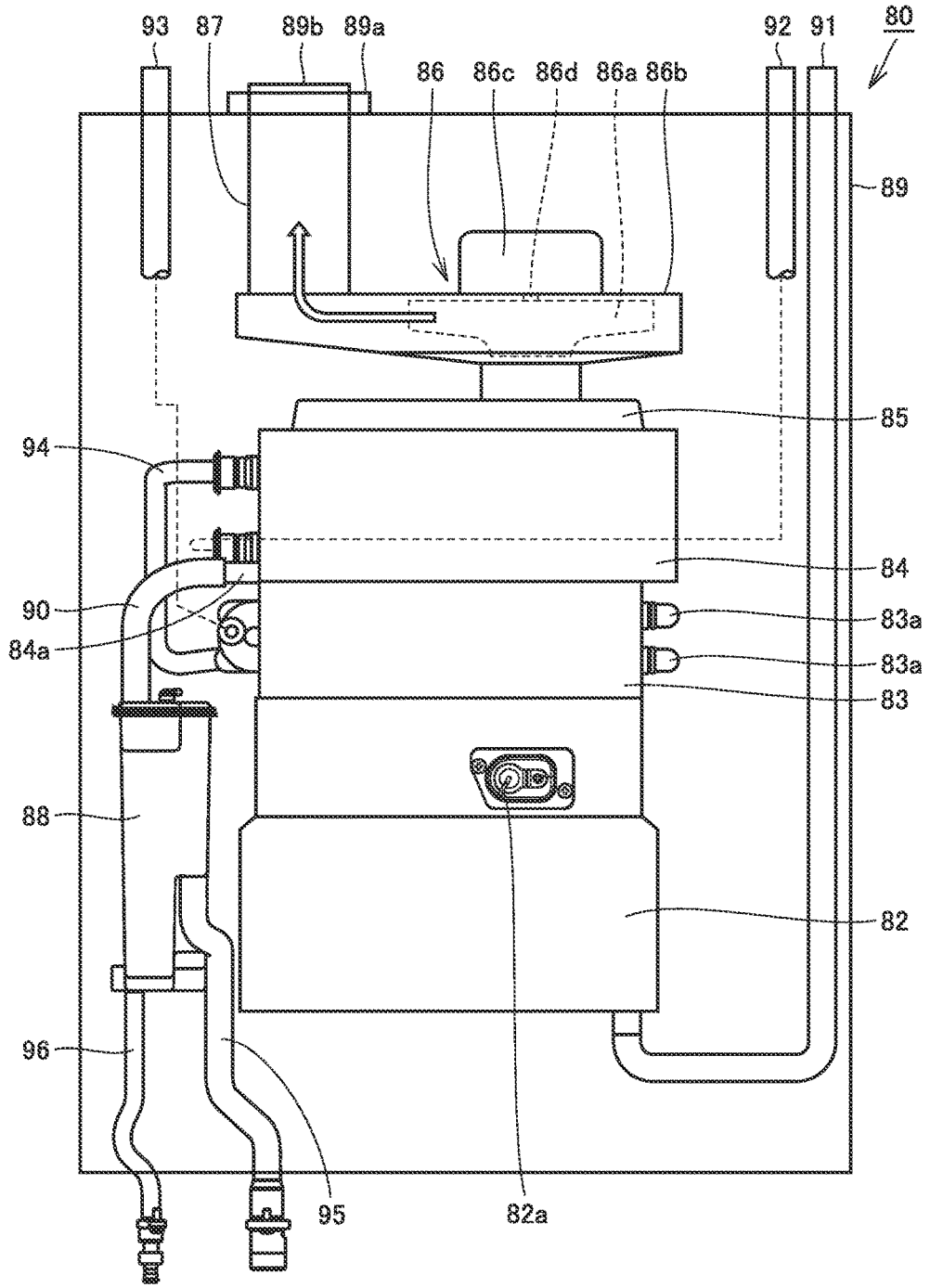
FIG. 20 is a front view schematically illustrating the configuration of a water heater which serves as an example of the exhaust structure for combustion apparatus according to an embodiment of the present invention.
Figure 21:
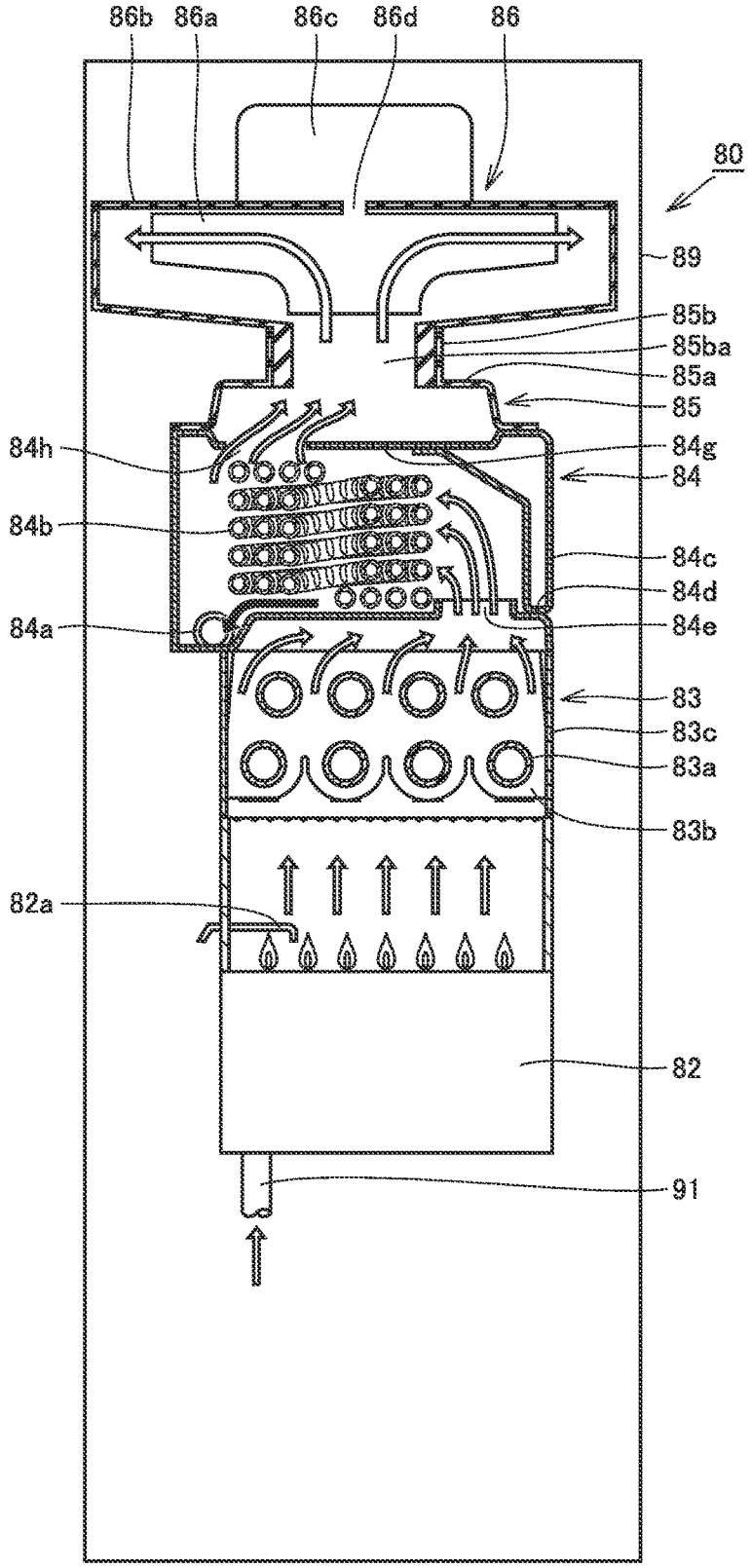
FIG. 21 is a partial cross-sectional side view schematically illustrating the configuration of the water heater illustrated in FIG. 20.

As illustrated in FIGS. 20 and 21, combustion apparatus 80 generally includes a burner 82, a primary heat exchanger 83, a secondary heat exchanger 84, an exhaust box 85, a fan 86, a connection pipe 87, a drainage water tank 88, a housing 89, and pipes 90 to 96.

Burner 82 is configured to produce combustion gas by combusting fuel gas. Burner 82 is connected to a gas supply pipe 91. Gas supply pipe 91 is configured to supply the fuel gas to burner 82. Gas supply pipe 91 is provided with a gas valve composed of an electromagnetic valve (not shown), for example.

A spark plug 82*a* is disposed above burner 82. This spark plug 82*a* is configured to produce ignition sparks between the spark plug and an ignition target (not shown) provided in burner 82 in response to the actuation of an ignition device (igniter) so as to produce a flame in a fuel air mixture erupted from burner 82. Burner 82 generates heat by combusting the fuel gas supplied from gas supply pipe 91 (hereinafter, it will be called as the combustion operation).

Primary heat exchanger 83 is a sensible heat recovery type heat exchanger. Primary heat exchanger 83 generally includes a plurality of plate-shaped fins 83*b*, a heat transfer tube 83*a* that penetrates the plurality of plate-shaped fins 83*b*, and a case 83*c* for housing therein the plurality of plate-shaped fins 83*b* and heat transfer tube 83*a*. Primary heat exchanger 83 is configured to perform heat exchange with the combustion gas generated by burner 82, specifically it is configured to heat water flowing in heat transfer tube 83*a* of primary heat exchanger 83 by using the heat generated through the combustion operation of burner 82.

Secondary heat exchanger 84 is a latent heat recovery type heat exchanger. Secondary heat exchanger 84 is located downstream of the flow of the combustion gas than primary heat exchanger 83, and is connected in series to primary heat exchanger 83. Thus, combustion apparatus 80 according to the present embodiment includes secondary heat exchanger 84 of latent heat recovery type, and thereby is a water heater of a latent heat recovery type.

Secondary heat exchanger 84 generally includes a drainage water discharge port 84*a*, a heat transfer tube 84*b*, a side wall 84*c*, a bottom wall 84*d*, and an upper wall 84*g*. Heat transfer tube 84*b* is spirally wound and laminated. Side wall 84*c*, bottom wall 84*d* and upper wall 84*g* are arranged to surround the periphery of heat transfer tube 84*b*.

In secondary heat exchanger 84, the hot water flowing in heat transfer tube 84*b* is pre-heated (heated) by the heat exchanged from the combustion gas after it is subjected to heat exchange in primary heat exchanger 83. During the process, as temperature of the combustion gas drops to about 60° C., the water vapor contained in the combustion gas is condensed, which makes it possible to recover the latent heat. After the latent heat is recovered in secondary heat exchanger 84, the water vapor contained in the combustion gas is condensed into drainage water.

Bottom wall 84*d* serves as a partition between primary heat exchanger 83 and secondary heat exchanger 84, and it also serves as an upper wall of primary heat exchanger 83. An opening 84*e* is provided on bottom wall 84*d*. Through the intermediary of opening 84*e*, the space where heat transfer tube 83*a* of primary heat exchanger 83 is arranged is brought into communication with the space where heat transfer tubes 84*b* of secondary heat exchanger 84 is arranged. As indicated by the hollow arrows in FIG. 21, the combustion gas can flow from primary heat exchanger 83 into secondary heat exchanger 84 through opening 84*e*. In the present embodiment, for the sake of simplification, bottom wall 84*d* of secondary heat exchanger 84 and the upper wall of primary heat exchanger 83 share a common wall, it is acceptable to have an exhaust collection and guide member connected between primary heat exchanger 83 and secondary heat exchanger 84.

Upper wall 84*g* is provided with an opening 84*h*. Through the intermediary of opening 84*g*, the space where heat transfer tube 84*b* of secondary heat exchanger 84 is arranged is brought into communication with the internal space of exhaust box 85. As indicated by the hollow arrows in FIG. 21, the combustion gas can flow from secondary heat exchanger 84 into the internal space of exhaust box 85 through opening 84*h*.

Drainage water discharge port 84*a* is provided on side wall 84*c* or bottom wall 84*d*. This drainage water discharge port 84*a* is opened at the lowest position (the lowermost position in the vertical direction after the water heater has been installed) in the space surrounded by side wall 84*c*, bottom wall 84*d* and upper wall 84*g*, which is lower than the lower end of heat transfer tube 84*b*. Accordingly, the drainage water which is produced in secondary heat exchanger 84 can be guided to drainage water discharge port 84*a* along bottom wall 84*d* and side wall 84*c* as indicated by a black arrow in FIG. 21.

Exhaust box 85 constitutes a flow path for the combustion gas between secondary heat exchanger 84 and fan 86. Through the intermediary of exhaust box 85, the combustion gas after the heat exchange with secondary heat exchanger 84 can be guided to fan 86. Exhaust box 85 is mounted on secondary heat exchanger 84, and is positioned downstream of the flow of the combustion gas than secondary heat exchanger 84.

Exhaust box 85 generally includes a box body 85*a* and a fan connection member 85*b*. The internal space of box body 85*a* is in communication with the internal space where heat transfer tubes 84*b* of secondary heat exchanger 84 is disposed through opening 84*h* of secondary heat exchanger 84. Fan connection member 85*b* is provided so as to protrude from the top of box body 85*a*. This fan connection member 85*b* has for example a cylindrical shape, and an internal space 85*ba* thereof is in communication with the internal space of box body 85*a*.

Fan 86 is configured to suck the combustion gas passed through secondary heat exchanger 84 (subjected to heat exchange with secondary heat exchanger 84) so as to discharge it the outside of combustion apparatus 80. Fan 86 is positioned downstream of the flow of the combustion gas than exhaust box 85 and secondary heat exchanger 84. In other words, in combustion apparatus 80, burner 82, primary heat exchanger 83, secondary heat exchanger 84, exhaust box 85 and fan 86 are arranged in the mentioned order from the upstream to the downstream of the flow of the combustion gas generated by burner 82. As mentioned in the above, since the combustion gas is discharged by fan 86 through suction, combustion apparatus 80 of the present embodiment is a water heater adapted to an exhaust suction and combustion system.

Fan 86 generally includes an impeller 86*a*, a fan case 86*b*, a drive source 86*c*, and a rotation shaft 86*d*. Fan case 86*b* is attached to fan connection member 85*b* of exhaust box 85 so as to communicate the internal space of fan case 86*b* with the internal space of fan connection member 85*b*. As indicated by the hollow arrows in FIG. 21, the combustion gas can be sucked from box body 85*a* of exhaust box 85 into fan case 86*b* through fan connection member 85*b*.

Impeller 86*a* is disposed inside fan case 86*b*. Impeller 86*a* is connected to drive source 86*c* through the intermediary of rotation shaft 86*d*. Thereby, impeller 86*a* is supplied with a driving force from drive source 86*c*, rotatable about rotation shaft 86*d*. Due to the rotation of impeller 86*a*, the combustion gas in exhaust box 85 can be sucked into the inner peripheral space of impeller 86*a* and expelled to the outer peripheral space of impeller 86*a*.

Connection pipe 87 is connected to a region outside the outer peripheral space where impeller 86*a* is disposed among the internal space of fan case 86*b*. Therefore, the combustion gas expelled to the outer peripheral space of impeller 86*a* by impeller 86*a* of fan 86 can be emitted into exhaust tube 20 through connection pipe 87.

As mentioned in the above, the combustion gas produced by burner 82 is sucked into fan 86 due to the rotation of impeller 86*a*, after sequentially passing through primary heat exchanger 83, secondary heat exchanger 84 and exhaust box 85, the combustion gas reaches fan 86 as indicated by the hollow arrows in FIG. 21, it can be discharged to the outside of combustion apparatus 80.

Drainage water tank 88 is configured to accumulate the drainage water generated in secondary heat exchanger 84. Drainage water tank 88 is connected to secondary heat exchanger 84 through pipe 90. Pipe 90 is connected to drainage water discharge port 84*a* of secondary heat exchanger 84, which makes it possible to drain the drainage water generated in secondary heat exchanger 84 into drainage water tank 88. This drainage water tank 88 is further connected with a pipe 95 extending to the outside of combustion apparatus 80. Thus, the drainage water accumulated in drainage water tank 88 can be drained to the outside of combustion apparatus 80 through pipe 95.

Drainage water tank 88 is provided with a water-seal structure. Specifically, drainage water tank 88 has such a structure that after the drainage water is accumulated in drainage water tank 88 to a predetermined amount, the accumulated drainage water prevents air from passing through drainage water tank 88. With the help of the water-seal structure of drainage water tank 88, the air outside combustion apparatus 80 (outside air) can be prevented from passing through drainage water tank 88 via pipe 95 to enter into combustion apparatus 80 (such as secondary heat exchanger 84).

In addition, a lower portion of drainage water tank 88 is connected to a drainage water drain pipe 96, separately from drainage water discharge pipe 95. Drainage water drain pipe 96 (which is normally closed) is configured to be opened for example during maintenance so as to discharge the drainage water which is accumulated in drainage water tank 88. Optionally, the internal space of drainage water tank 88 may be filled with a neutralizing agent (not shown) so as to neutralize the acidic drainage water.

A water supply pipe 92 is connected to one end of heat transfer tube 84*b* of secondary heat exchanger 84, and a hot water delivery pipe 93 is connected to one end of heat transfer tube 83*a* of primary heat exchanger 83. Further, the other end of heat transfer tube 83*a* of primary heat exchanger 83 and the other end of heat transfer tube 84*b* of secondary heat exchanger 84 are connected to each other by a pipe 94. Each of gas supply pipe 91, water supply pipe 92 and hot water delivery pipe 93 mentioned above leads to the outside at a top portion of combustion apparatus 80, for example. In addition, burner 82, primary heat exchanger 83, secondary heat exchanger 84, exhaust box 85, fan 86, drainage water tank 88 and the like are disposed inside housing 89.

Housing 89 includes a connection member 89*a* and an exhaust member 89*b*. Specifically, connection member 89*a* which protrudes upward in tubular shape and exhaust member 89*b* which protrudes upward in tubular shape are provided concentrically on the upper surface of housing 89. In other words, connection member 89*a* and exhaust member 89*b* constitute a double pipe structure.

Connection member 89*a* is disposed to surround the outer peripheral surface of exhaust member 89*b*, and is provided with a connection hole in a region inside housing 89 between the outer surface of exhaust member 89*b* and the inner peripheral surface of connection member 89*a*. Further, an exhaust vent is provided in housing 89 inner to exhaust member 89*b*. The connection hole is in communication with the interior of housing 89, and the exhaust vent is in communication with the interior of connection pipe 87. Thereby, the vacancy between the outer peripheral surface of exhaust tube 20 and the inner peripheral surface of connection pipe 60 is brought into communication with the internal space of housing 89 via the connection hole provided in housing 89. Further, the combustion gas after passing through burner 82 is fed from connection pipe 87 into exhaust tube 20 through exhaust member 89*b*.

Connection member 89*a* is connected to connection pipe 60 at one end side of connection pipe 60, and exhaust member 89*b* is connected to exhaust tube 20 at one end 20*a* of exhaust tube 20. Note that exhaust member 89*b* may be also connected to connection pipe 87 which is housed inside housing 89. For example, in the case where exhaust member 89*b* is configured to protrude from the upper surface of housing 89 downward in tubular shape, the connection between exhaust member 89*b* and connection pipe 87 will become easier.

Connection member 89*a* and connection pipe 60 may be connected in such a manner that no gas flowing inside will leak out. Similarly, exhaust member 89*b* and exhaust tube 20 (and connection pipe 87) may be connected in such a manner that no gas flowing inside will leak out. Thus, an O-ring may be interposed between the two connected parts or a binding band may be used to firmly bind the two connected parts. The two parts may be outer attached or inner attached to each other.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An exhaust tube holding member formed into an annular shape and configured to be supported by an exhaust pipe at a location closer to the side of an outer peripheral surface of the annular shape and to hold an exhaust tube on an inner peripheral surface of the annular shape, the exhaust tube holding member comprising:

an annular portion formed with a through hole penetrating from a first end through a second end;

an outward protruding portion formed into an annular shape and protruding peripherally outward from the outer peripheral surface of the annular portion; and a flange portion disposed closer to the first end than to the outward protruding portion, extending peripherally outward from the outer peripheral surface of the annular portion, and configured to have a thickness greater than that of the outward protruding portion, the flange portion being formed with a first annular groove surrounding the through hole, the first annular groove including a first groove portion formed on one surface of the flange portion closer to the first end, and a second groove portion formed on the other surface of the flange portion closer to the second end, the first groove portion and the second groove portion being formed peripherally opposite to each other in the direction of the central axis of the through hole.

2. The exhaust tube holding member according to claim 1, wherein the first annular groove is formed concentrically with the through hole in planar view.

3. The exhaust tube holding member according to claim 1, wherein the first annular groove is formed to have an oval shape or an elliptical shape sharing the same central axis with the through hole in planar view.

4. The exhaust tube holding member according to claim 1, wherein the outward protruding portion is formed with a second annular groove surrounding the through hole.

5. The exhaust tube holding member according to claim 4, wherein the first annular groove and the second annular groove have the same radius in planar view.

6. The exhaust tube holding member according to claim 1, wherein the sum of the depth of the first groove portion and the depth of the second groove portion is at least half of the thickness of the flange portion.

7. An exhaust structure for combustion apparatus comprising:

the exhaust tube holding member according to claim 1;

the exhaust tube which has one end and the other end and is connected to a combustion apparatus at one end;

the exhaust pipe into which the exhaust tube is introduced; and a rain cap connected to the other end of the exhaust tube and configured to cover the top of the exhaust tube holding member, the annular portion of the exhaust tube holding member being attached to the outer peripheral surface of the exhaust tube, the flange portion being held at the upper end of the exhaust pipe, and the outer peripheral end of the outward protruding portion being in contact with the inner peripheral surface of the exhaust pipe.

8. A method for installing an exhaust structure for a combustion apparatus by using the exhaust tube holding member according to claim 1, the method comprising:

cutting the flange portion along the first annular groove of the exhaust tube holding member;

connecting the exhaust tube which has one end and the other end to the combustion apparatus at one end, and pulling the other end of the exhaust tube through the exhaust pipe out of an upper end opening of the exhaust pipe;

attaching the exhaust tube holding member to the outer peripheral surface of the exhaust tube by introducing the exhaust tube into the through hole of the exhaust tube holding member; and holding the exhaust tube holding member which has been attached to the outer peripheral surface of the exhaust tube against the upper end opening of the exhaust pipe.

9. The method for installing an exhaust structure for a combustion apparatus according to claim 8, wherein the cutting of the flange portion along the first annular groove is performed prior to the attaching of the exhaust tube holding member to the outer peripheral surface of the exhaust tube.

10. The method for installing an exhaust structure for a combustion apparatus according to claim 8, wherein the cutting of the flange portion along the first annular groove is performed after the attaching of the exhaust tube holding member on the outer peripheral surface of the exhaust tube.

11. The method for installing an exhaust structure for a combustion apparatus according to claim 8, wherein the outward protruding portion is formed with a second annular groove surrounding the through hole, the method further comprises cutting the outward protruding portion along the second annular groove.

* * * * *